US009290301B2

(12) United States Patent
Dominski et al.

(10) Patent No.: US 9,290,301 B2
(45) Date of Patent: Mar. 22, 2016

(54) PACKAGING OF MULTIPLE CUPS

(75) Inventors: Daniel Dominski, San Ramon, CA (US); Brian J. Olson, Pleasanton, CA (US); Roy Greengrass, Discovery Bay, CA (US); James E. McCay, Fairfield, CT (US); Jonathan Lee, Westchester, IL (US); Thomas Lebeau, Montreal (CA)

(73) Assignee: Del Monte Foods, Inc., San Francisco, CA (US)

( * ) Notice: Subject to any disclaimer, the term of this patent is extended or adjusted under 35 U.S.C. 154(b) by 0 days.

(21) Appl. No.: 13/292,610

(22) Filed: Nov. 9, 2011

(65) Prior Publication Data

US 2013/0112581 A1 May 9, 2013

(51) Int. Cl.

| | |
|---|---|
| ***B65D 75/00*** | (2006.01) |
| ***B65D 25/00*** | (2006.01) |
| ***B65D 85/00*** | (2006.01) |
| ***B65D 71/16*** | (2006.01) |
| ***B65D 71/20*** | (2006.01) |
| ***B65D 71/22*** | (2006.01) |
| ***B65D 71/34*** | (2006.01) |
| ***B65D 71/36*** | (2006.01) |
| ***B65D 71/46*** | (2006.01) |
| *B65D 71/32* | (2006.01) |

(52) U.S. Cl.

CPC ..... *B65D 25/00* (2013.01); *B65D 71/16* (2013.01); *B65D 71/20* (2013.01); *B65D 71/22* (2013.01); *B65D 71/34* (2013.01); *B65D 71/36* (2013.01); *B65D 71/46* (2013.01); *B65D 85/00* (2013.01); *B65D 71/32* (2013.01); *B65D 2571/0066* (2013.01); *B65D 2571/00141* (2013.01); *B65D 2571/00277* (2013.01); *B65D 2571/00283* (2013.01); *B65D 2571/00314* (2013.01); *B65D 2571/00444* (2013.01); *B65D 2571/00561* (2013.01); *B65D 2571/00716* (2013.01); *B65D 2571/00728* (2013.01)

(58) Field of Classification Search

CPC ..... B65D 25/00; B65D 71/16; B65D 71/20; B65D 71/22; B65D 71/34; B65D 71/36; B65D 71/46; B65D 2571/00728; B65D 2571/00141; B65D 2571/00277; B65D 2571/00283; B65D 2571/00314; B65D 2571/00444; B65D 2571/00561; B65D 2571/0066; B65D 2571/00716; B65D 85/00

USPC ..... 206/427, 430, 434, 432, 428, 429, 499, 206/152, 155, 156, 158, 526; 229/117.13, 229/103.2, 40; 220/62; 493/84; 426/108, 426/119

See application file for complete search history.

(56) References Cited

U.S. PATENT DOCUMENTS 2,928,541 A * 3/1960 Fielding ..... 206/427
3,677,458 A * 7/1972 Gosling ..... 229/120.011

(Continued)

*Primary Examiner* — Anthony Stashick
*Assistant Examiner* — James M Van Buskirk
(74) *Attorney, Agent, or Firm* — Stradley Ronon Stevens & Young, LLP

(57) ABSTRACT

Devices and methods for packaging food cups is provided. The devices include unitary blanks with a front panel, bottom panel, rear panel, top panel, and side closures (in various forms) configured for assembly into a hollow substantially polyhedral package enclosure for 2 cups, 4 cups, or other even number of cups. Package enclosures with different side closures are designed for assembly with no glue joints, one glue joint, 3 glue joints (two cup enclosure), or 5 glue joints. Package enclosures provide visual displays that permit viewing of contents of cups secured in the enclosures. Package enclosures are structurally stable for packaging, transport, and storage. And the visual displays provide aesthetic appeal for consumers. Material and manufacturing costs and product waste are minimized with the invention.

48 Claims, 34 Drawing Sheets

(56) References Cited

U.S. PATENT DOCUMENTS 4,895,296 A * 1/1990 Trauschke ..... 206/526
5,429,239 A * 7/1995 Baxter ..... 206/434
6,105,774 A * 8/2000 Jackson ..... 206/434
7,353,940 B2 * 4/2008 Sendo ..... 206/268
7,367,453 B2 * 5/2008 Sutherland ..... 206/427
7,374,038 B2 * 5/2008 Smalley ..... 206/175
7,658,317 B2 * 2/2010 Wilkins ..... 229/122.1

* cited by examiner

PACKAGING OF MULTIPLE CUPS

FIELD OF THE INVENTION

The present invention generally relates to improvements in the arrangement and packaging of multiple food cups within an outer package enclosure.

BACKGROUND OF THE INVENTION

Many consumer products are distributed to stores, and then sold to the end consumer, in multiple product packages enclosed in an outer package or container. These multipack systems are designed to serve a number of purposes. For example, these purposes include, but are not limited to, protection of smaller internal packages during transportation and handling, product promotion, shelf-appeal and shelf-stability at the store, portion control, ease of carrying, ease of opening, ease of storage, and offering end-consumers the ability to organize their shelves. The design and engineering of multipack systems requires balancing conflicting design objectives because aesthetics of design elements may need to be sacrificed for functionality.

Designing multipack systems becomes more complex if the consumer products to be packaged in plurality are not of a uniform shape such as a cube, a sphere, or a cylinder. As an example, the geometry of tapered food cups presents special design challenges for packages. It is standard practice to arrange tapered cups in multiple rows—stacked one on top of the other—within an outer container or carton. This package arrangement must exhibit aesthetic appeal and also provide structural characteristics along with functionality. In transport and storage, the package must provide internal stability to avoid crushing its contents and, also, external stability to support stacking multiple packages. The aesthetics of the package design create an impact when packages are displayed on a store shelf. The package allows consumers to view the contents of packaged cups to trigger an impulse to buy. Another practical benefit of the package is its capability to be used to store the cups at home in an organized manner in the outer package.

Where fruit cups are sold in grocery aisles in competitive markets, minimizing the cost and environmental footprint of the outer package while, also, enhancing stability, shelf-appeal, and storage ease is sought by manufacturers and consumers. Fruit cups are made in transparent plastic so that the fruit inside is visible and appealing to consumers. It allows consumers to see the size, texture, and volume of the fruit and consequently to serve as a driver of sales. Shelf visibility enhances consumer perceptions that the fruit is fresh. However, visualization is defeated when transparent fruit cups containing juicy fruit are put into outer packaging that obscures the view of the product inside.

Merchants and consumers are served well with multipacks. Shelf space at grocery stores and in home refrigerators and pantries is available—but at a premium. Packaging systems for cups promotes multipack stacking without significant concern for loss or injury by tipping. For convenience, packaging systems offer assistance in shelf organization in the refrigerator or pantry and retrieval of packaged cups. The review of the prior art presented in this background shows that there is significant room for improving multipack systems, especially multipacks for cups and other containers.

For example, U.S. Pat. No. 4,164,286 shows a package adapted for enclosing unstacked, side-by-side rows of product-filled tapered cups with the openings of all of the cups configured in one direction. The package includes an essential triangular wedge running between the rows along the bottom of each cup's taper to keep the cups stable within the package without end closures. This configuration has its drawbacks. It requires a large amount of outer packaging material, which not only increases packaging costs, but also is becoming increasingly perceived as wasteful by environmentally conscious consumers. Another drawback is that the cups are barely visible to the consumer when the package is displayed on a store shelf.

In an example, FIG. 1A shows a contemporary and low cost shrink wrap system for packaging cups. Shrink wrap promotes product visibility on the store shelf. However, the drawbacks of using shrink wrap include lower product protection, and, once the shrink wrap is opened at home, the cups have to be individually organized. An additional drawback is exposure of open ends of the package showing non-uniform shrink wrap. This creates a product display that conveys an appearance of low quality, aesthetics, and sophistication.

In another example, FIGS. 1B, 1C, and 1D show other systems for packaging cups. Packaging may be used to secure together tapered cups that are stacked with tops in contact with one another as shown in FIG. 1B. In this configuration, the cups are exposed to abuse during transport and storage and, once the package is torn to retrieve a cup, its life as a storage device is completed. Another example shown in FIG. 1C illustrates tapered cups stacked top down in a horizontal row. The top of the package does not provide a uniform stacking surface. A further example shown in FIG. 1D illustrates tapered cups stacked upright and packed vertically. In the examples of FIGS. 1C and 1D, the packaging must be torn to access the cups, and the integrity of the package is compromised. Another drawback in these examples is the packages' instability on the store shelf.

A further example of a package is shown in FIGS. 2A, 2B, and 2C. Three different views illustrate a package for tapered fruit cups that has been in commercial use for almost a decade in grocery stores in the United States. The cups are stacked top to top on each other so that the larger diameter tops are positioned in the middle of the package and the tapered bottoms are adjacent to the outer package. Small longitudinal slots are aligned horizontally in the sides of the package and receive the tops of the tapered cups to prevent the cups from sliding out of the package along its opened ends. Another opening is cut into each of the longitudinal sides of the package to provide visual access to the packaged product. In this package, however, less than 20% of each fruit cup is visible through the opening to the consumer while the package is on display. Another drawback of this configuration is its instability on the store shelf. Because the tapered bottom of the cup forms the face on which the outer package stands, these packages topple easily when stacked on grocery store shelves, often creating a mess in the store and loss of product through breakage. Yet another drawback is end user inconvenience. Once the package is taken home by the consumer and opened, the ability to organize and store individual cups contained in an outer package is lost.

The package of FIGS. 2A, 2B, and 2C is assembled from a unitary piece of paperboard stock. FIGS. 2D and 2E show cut paperboard blanks for similar packaging. These figures illustrate that the package lacks substantial side supports as it simply wraps around the tapered cups and is glued to itself. In addition, as cups are removed from the store shelf by a consumer, the open ends on the side of the package tend to catch on other adjacent packages, dragging them aside, and in some cases causing those packages to topple off the shelf and onto the floor.

In a further configuration, FIG. 3 shows packaging of a yogurt product. The outer package contains 4 cylindrical glass jars of yogurt product stacked vertically in a single row. A main drawback of this package system is the need and the costs for increased strength of holding material of the outer package because the jars are heavy. The package provides less than 20% visibility of the packaged yogurt jars. Further, once the consumer brings the product home and breaks open the package, each jar has to be stored separately because the package is rendered useless for storage.

Outer packages have also been developed to double as storage packs for consumer products. These packages tend to fully enclose products having a more uniform shape, such as cylindrically-shaped soft drink cans. For example, United States Patent Application Publication No. 2008/0078820 shows a carton for holding cylindrical cans. A tear line is provided along the middle of the carton to facilitate splitting the carton along the tear line into two packs for two purposes. The first is to provide convenient storage in a pantry and organization in the refrigerator, and the second is to promote easy retrieval of soft drinks. In this configuration, however, the packages are designed for cylindrical objects, and the cans inside the package are not visible on the store shelf. While product visibility is far less important for soft drinks, it is, however, a very important factor for fresh consumables like fruits and vegetables.

The description of the prior art provided in this disclosure highlights the need for an improved packaging system for arranging product cups, particularly fruit cups, or other containers in a multipack in such a way that (1) the multipacks are structurally stable on the shelf and can be stacked on top of each other; (2) the individual product cups are highly visible through the package to enhance package aesthetics and shelf-appeal to the consumer while concurrently enclosing the tapered cups so that they do not fall out of the outer package; (3) the outer package easily converts into a stable storage pack for organization and product retrieval in a consumer's pantry or refrigerator; (4) the amount of materials used for the outer package, and costs for production, are minimized; and (5) susceptibility to packaging failures is minimized by reducing the number of glue joints.

BRIEF DESCRIPTION OF THE DRAWINGS

Additional aspects, features, and advantages of the invention, both as to its structure, assembly, and use, will be understood and will become more readily apparent when the invention is considered in light of the following description of illustrative embodiments made in conjunction with the accompanying drawings, wherein.

DETAILED DESCRIPTION OF EMBODIMENTS OF THE INVENTION

Illustrative and alternative embodiments of a packaging system for a plurality of food cups will be discussed in detail below with reference to the figures provided with this application. The invention provides an improved multipack package system for food cups, tapered food cups, or other containers. A purpose of the package system is to provide structural and functional stability for commercial transport, storage, and shelf display. Another purpose of the invention is to provide significant visual access to the contents of the cups 200 secured in an enclosure to enhance aesthetics and shelf-appeal. A further purpose is to combine aesthetically appealing packaging with a functional and structurally sound container. Yet another purpose is to provide a convertible outer package that becomes a stable storage pack for organization and product retrieval in a consumer's pantry or refrigerator. Glue joints represent a common failure point and misaligned area in the manufacturing process. Therefore, an even further purpose of the invention is to minimize package failure rate and the amount of materials and time used to manufacture and assemble the packages and to reduce production costs.

An illustrative embodiment of the invention—a packaging system with cups 200 enclosed in an outer package—is described. While the packaging system is useful for enclosing two cups, four cups, and other even number of cups configured for packaging of the invention, the embodiment described first is the package enclosure 20 for four cups. Although similar aspects of the embodiments of the invention are featured throughout this application and are readily apparent, these similarities will be repeated as needed in context with the variations of each embodiment.

In order to appreciate the general dimensions of the invention, it is beneficial to begin with an understanding of the physical characteristics of its contents.

As a non-limiting example, cups 200 may comprise a top diameter of about 3 inches, a bottom diameter of about 1¾ inch, and a height of about 1¾ inch. Around its top surface, cup 200 has circumferential edge 202 comprising an annular rim. Other cup dimensions and configurations may be packaged with the invention. The dimensions of the invention may be modified to create parity with the dimensions of alternative sizes and shapes of cups, tapered cups, other cup configurations, or any other container that the invention may be used to enclose.

Referring now to the four cup embodiment of the invention illustrated in FIGS. 4A through 4I, the invention generally comprises enclosure 20 in the shape of a hollow and substantially rectangular polyhedron. As a non-limiting example, the general overall dimensions of enclosure 20 comprise height of about 3½ inches, width of about 6¾ inches, and depth of about 3¼ inches. These dimensions may be modified to enclose various cup or container embodiments.

Figure 1A:
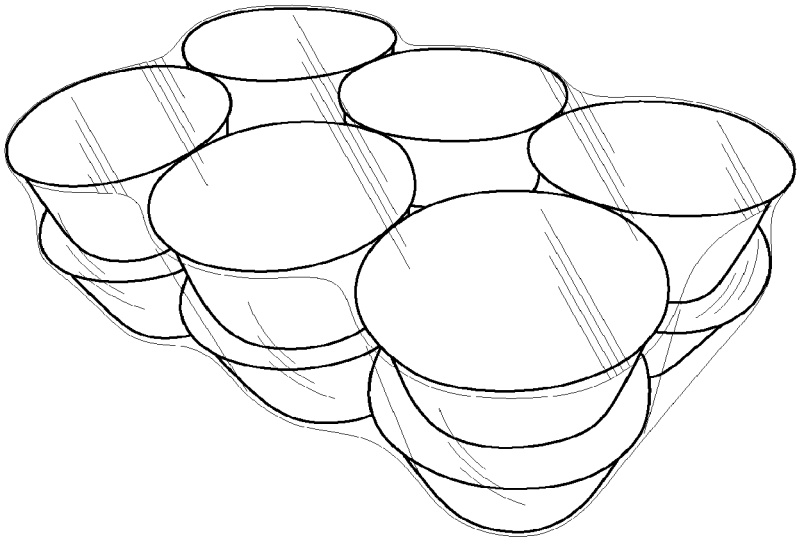
FIG. 1A Prior Art
FIG. 1A is an image of shrink wrap packaging of stacked tapered fruit cups.
Figure 1B:
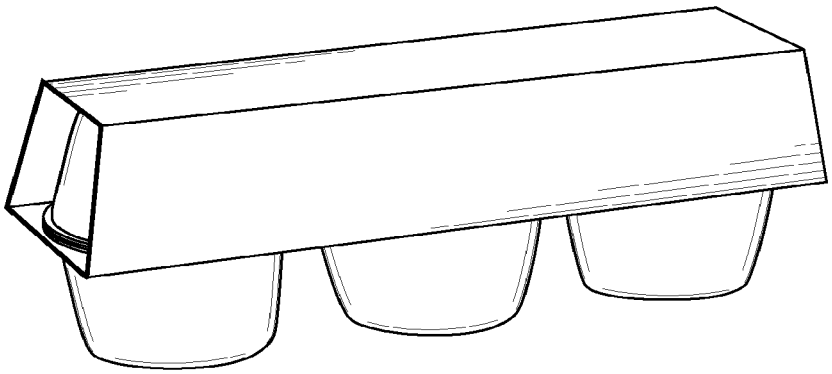
FIG. 1B Prior Art
FIGS. 1B, 1C, and 1D show images of paperboard package systems for stacked and side-by-side tapered food cups.
Figure 1C:
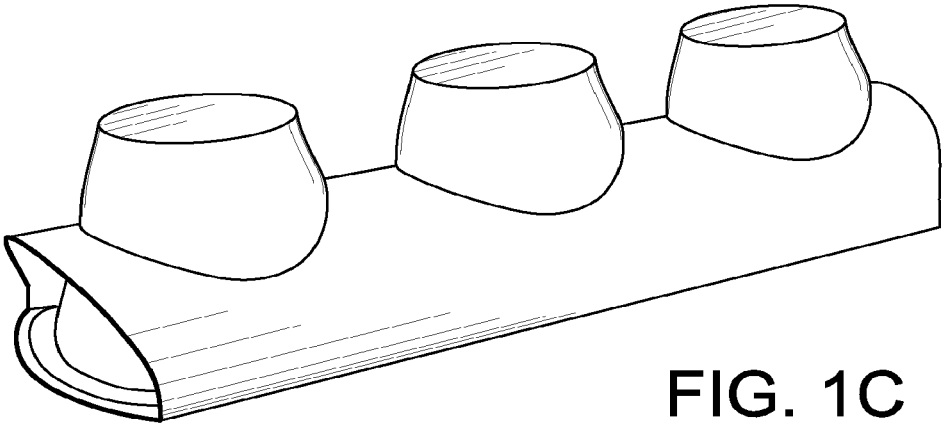
FIG. 1C Prior Art
Figure 1D:
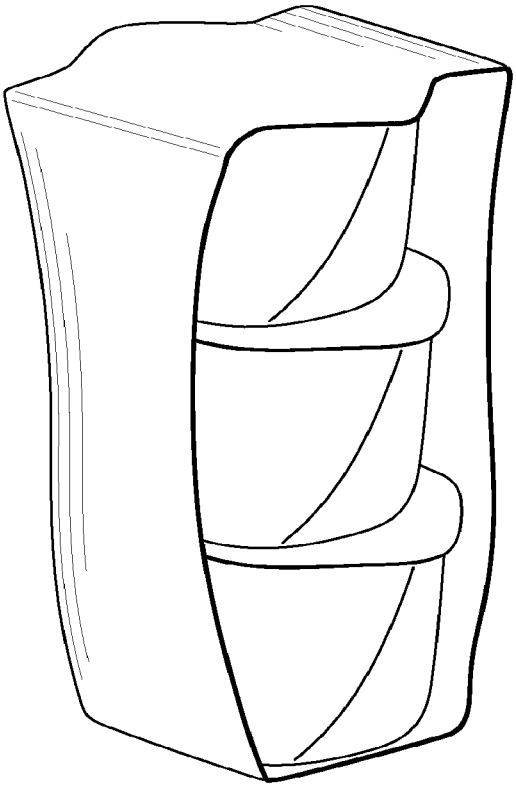
FIG. 1D Prior Art
Figure 2A:
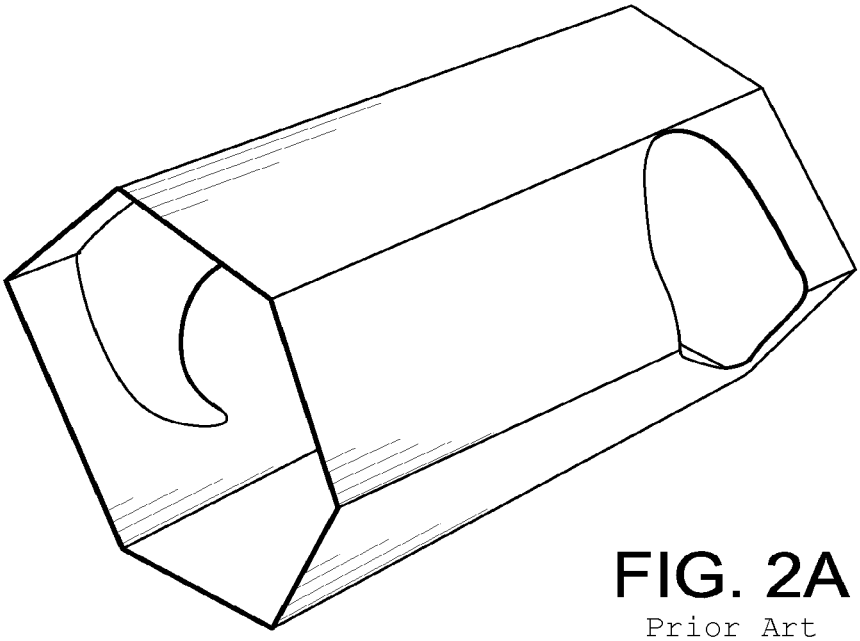
FIG. 2A Prior Art
FIGS. 2A, 2B, and 2C show elevated, front, and side views of existing commercial packaging for tapered food cup products.
Figure 2B:
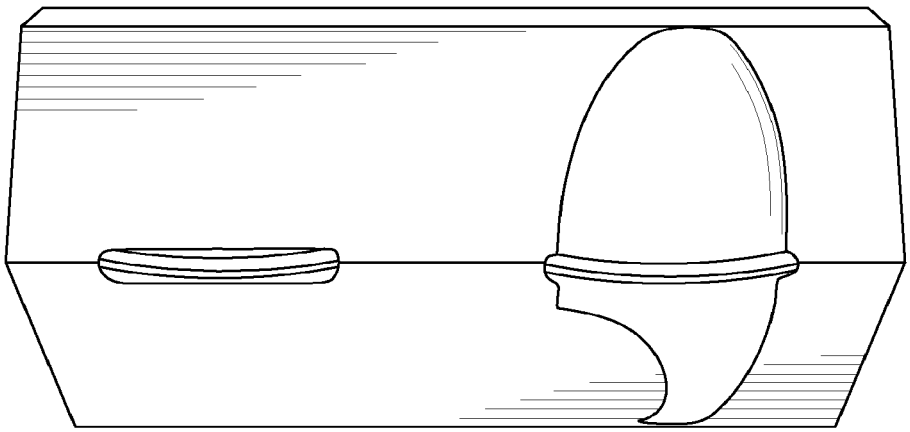
FIG. 2B Prior Art
Figure 2C:
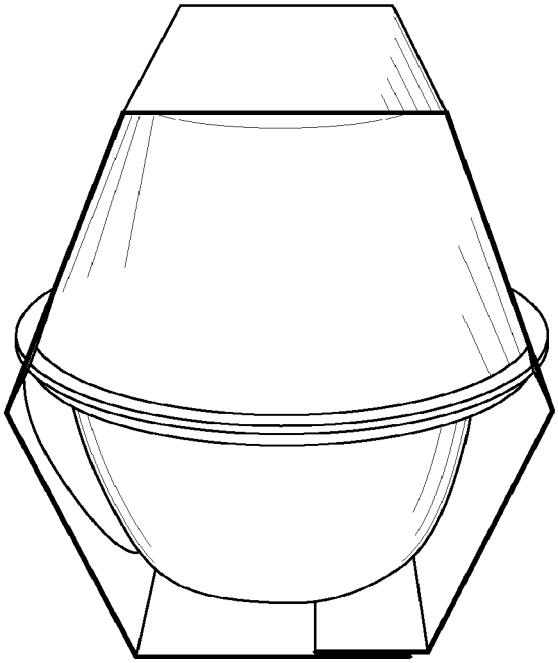
FIG. 2C Prior Art
Figure 2D:
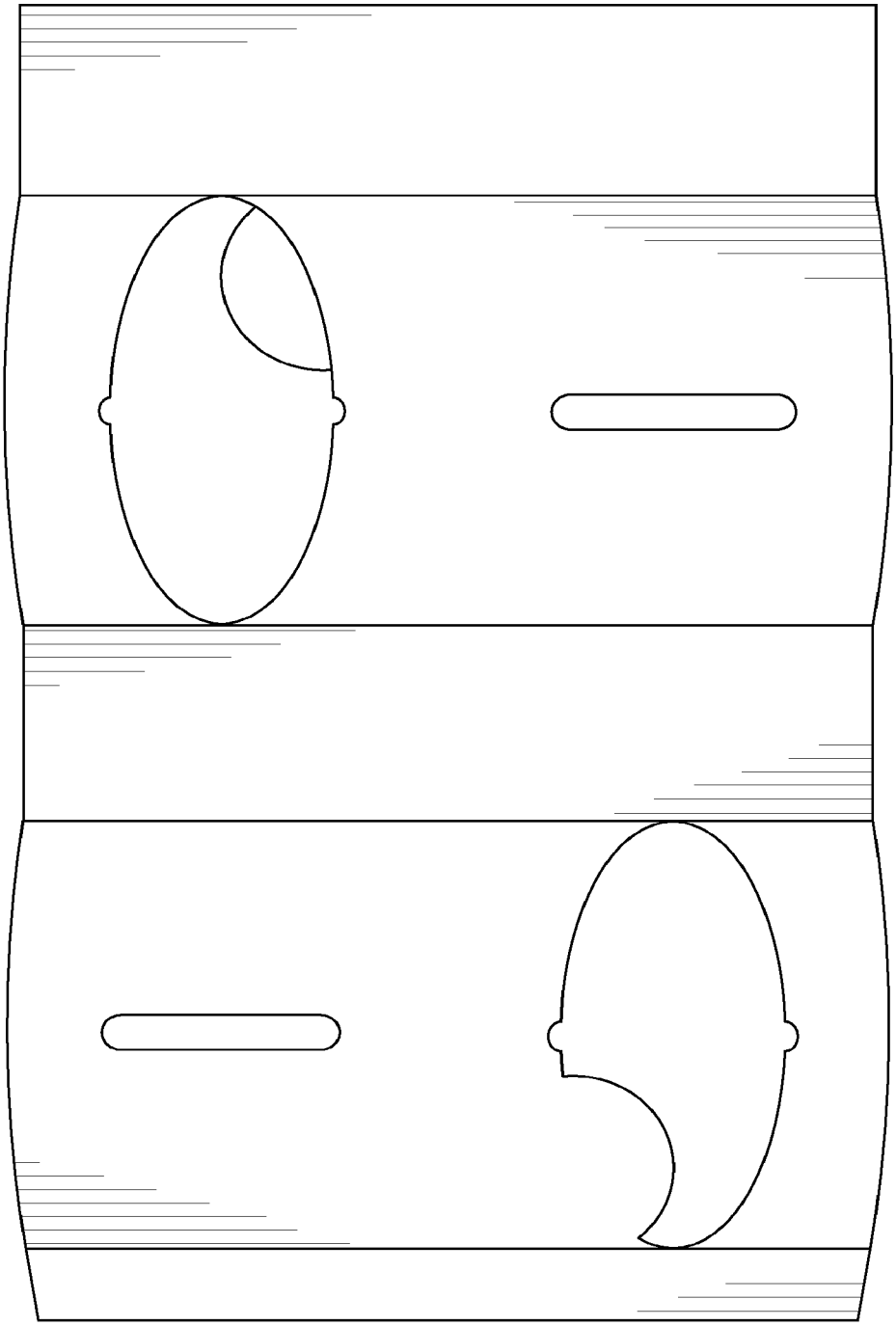
FIG. 2D Prior Art
FIGS. 2D and 2E show unitary paperboard blanks prior to assembly into the package shown in FIGS. 2A, 2B, and 2C.
Figure 2E:
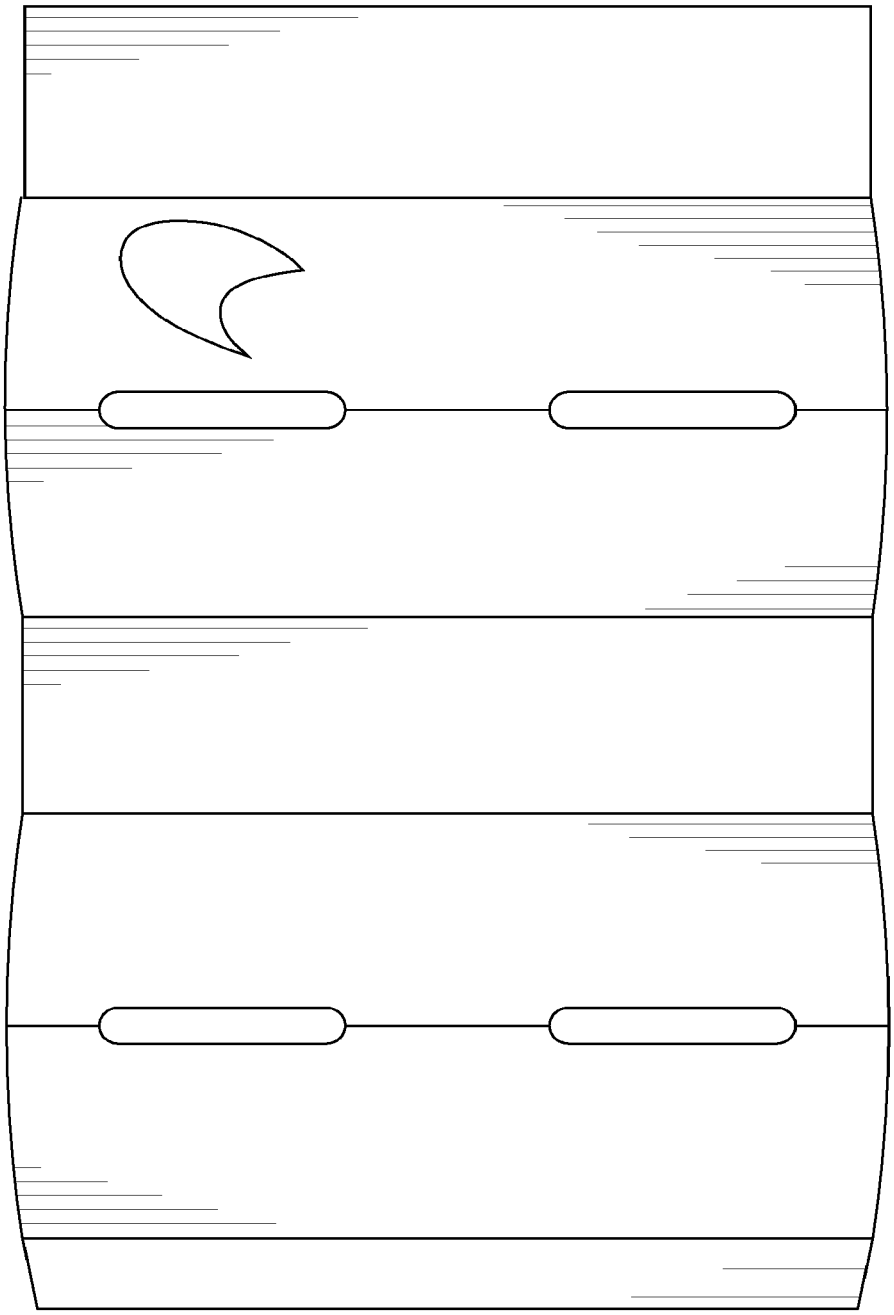
FIG. 2E Prior Art
Figure 3:
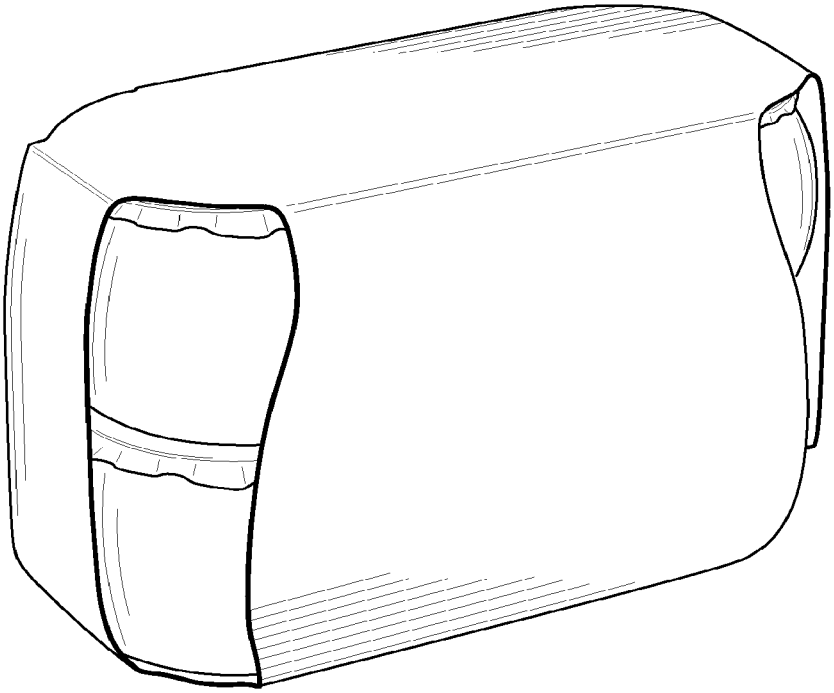
FIG. 3 Prior Art
FIG. 3 shows an outer package enclosing glass yogurt jars.
Figure 4A:
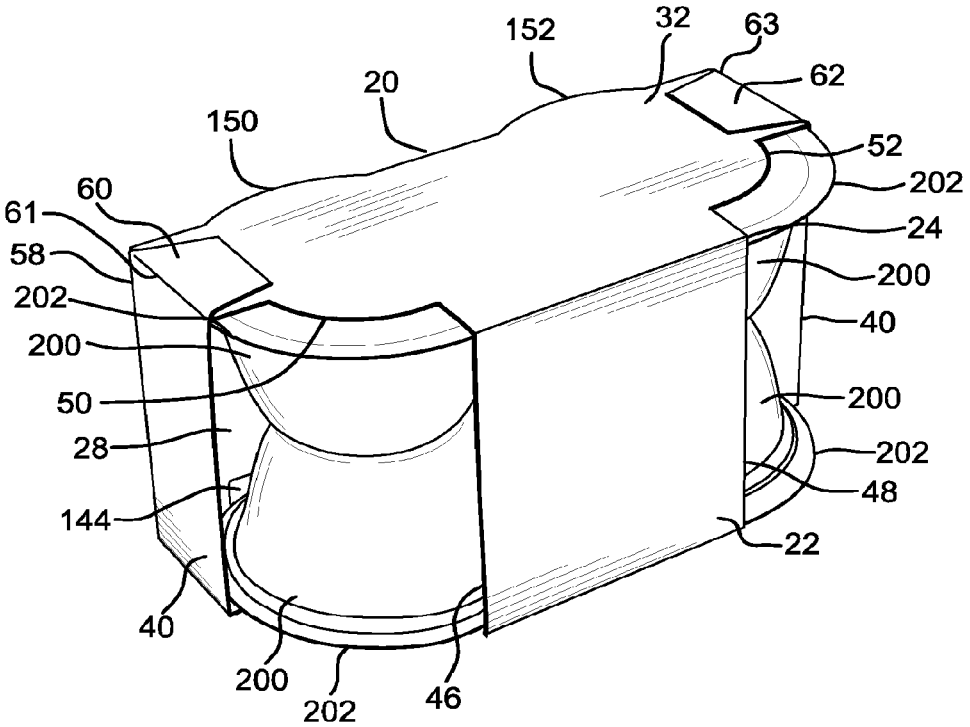
FIG. 4A shows a front elevated view of a 4-cup package enclosure having 5 glue joints.
Figure 4B:
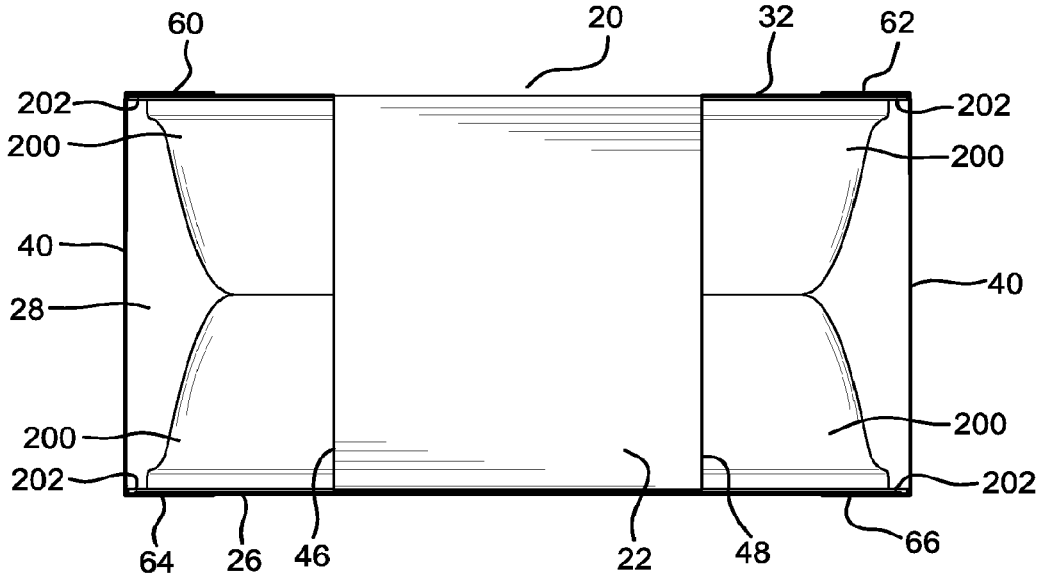
FIG. 4B shows a front view of the 5-glue joint package of FIG. 4A.
Figure 4C:
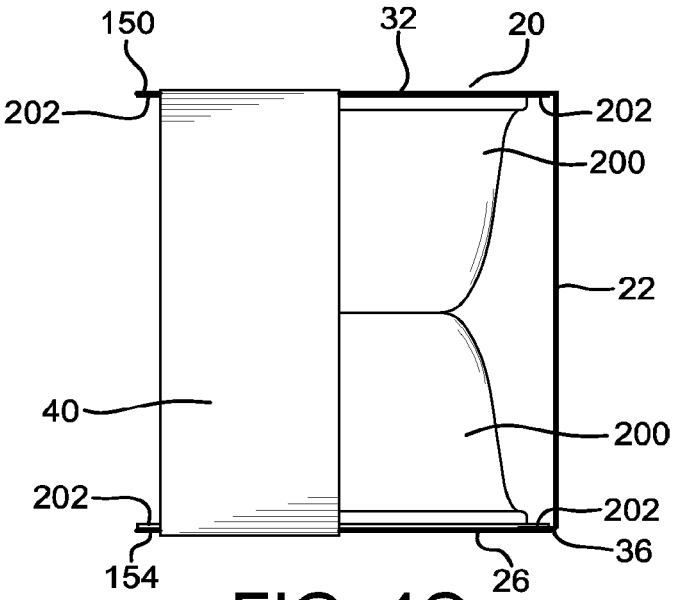
FIG. 4C shows a side view of the 5-glue joint package of FIG. 4A.
Figure 4D:
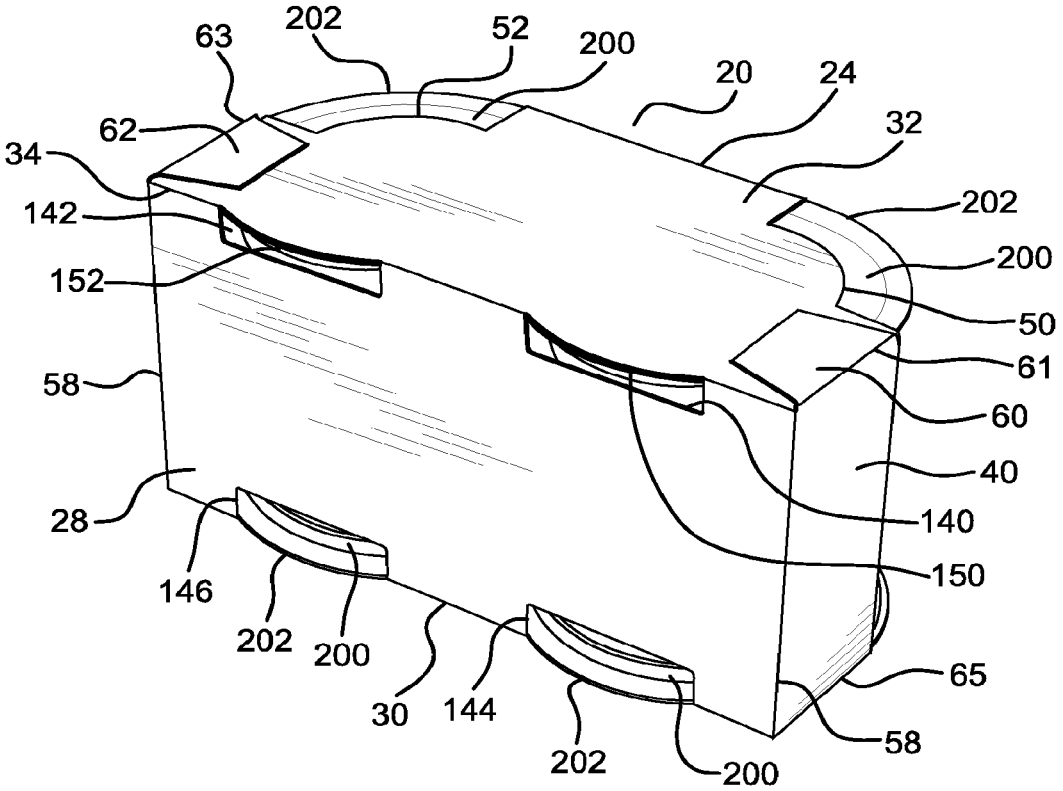
FIG. 4D shows a rear elevated view of the 5-glue joint package of FIG. 4A.
Figure 4E:
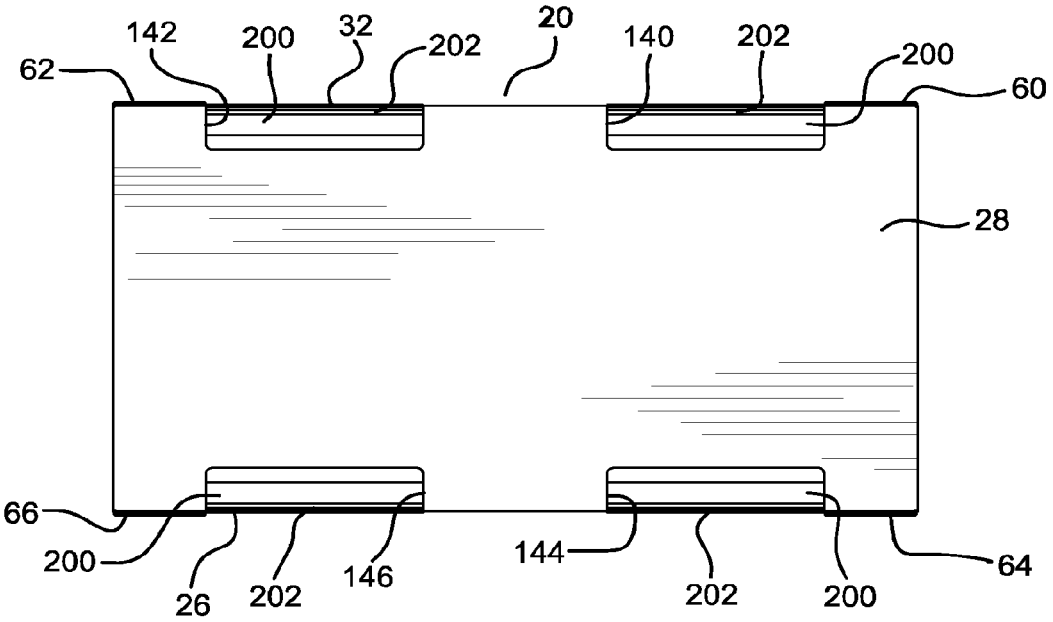
FIG. 4E shows a rear view of the 5-glue joint package of FIG. 4A.
Figure 4F:
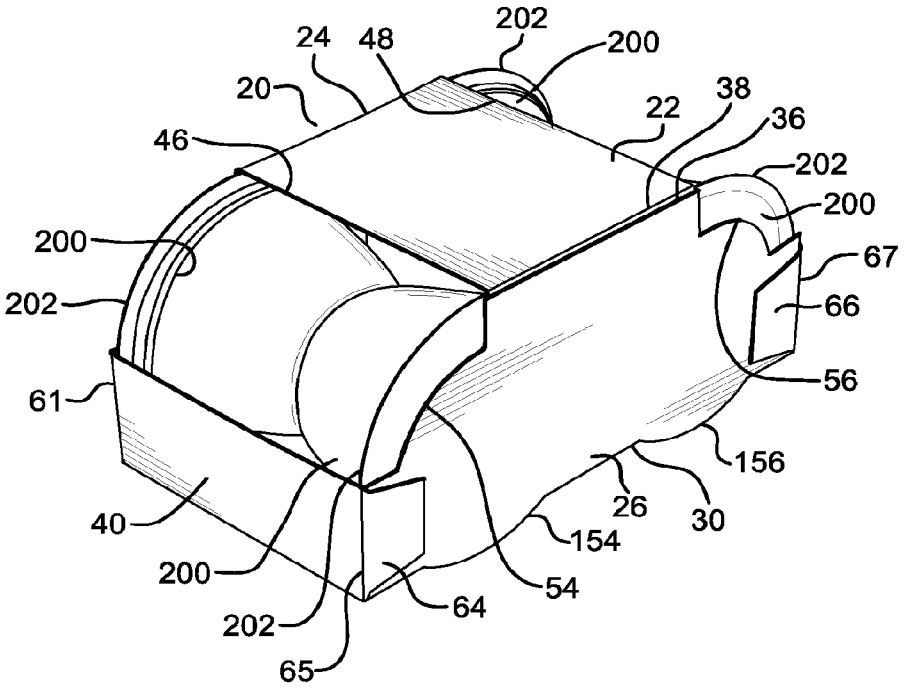
FIG. 4F shows a bottom elevated view of the 5-glue joint package of FIG. 4A.
Figure 4G:
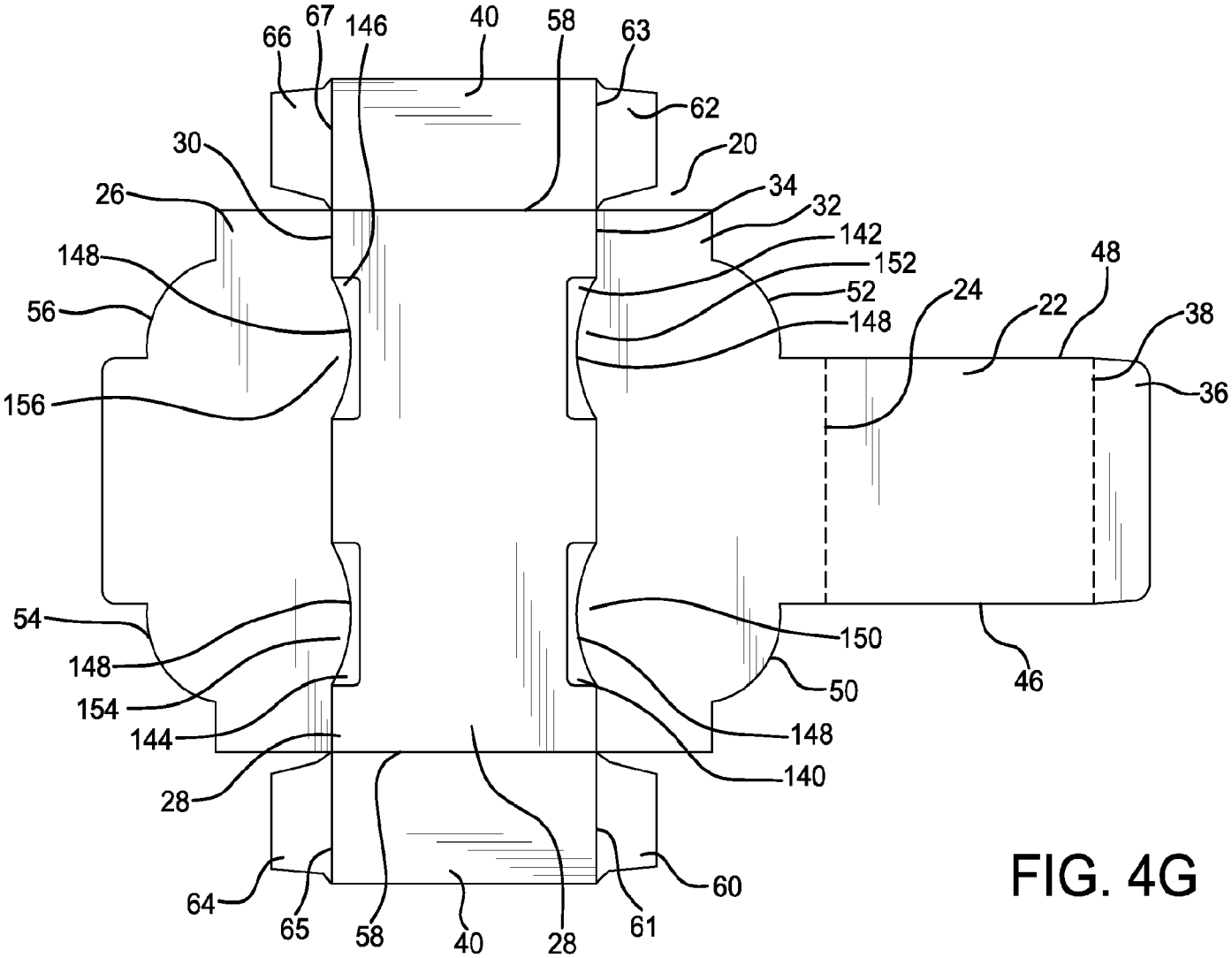
FIG. 4G shows a unitary blank used for assembly of the 5-glue joint package of FIG. 4A.
Figure 5A:
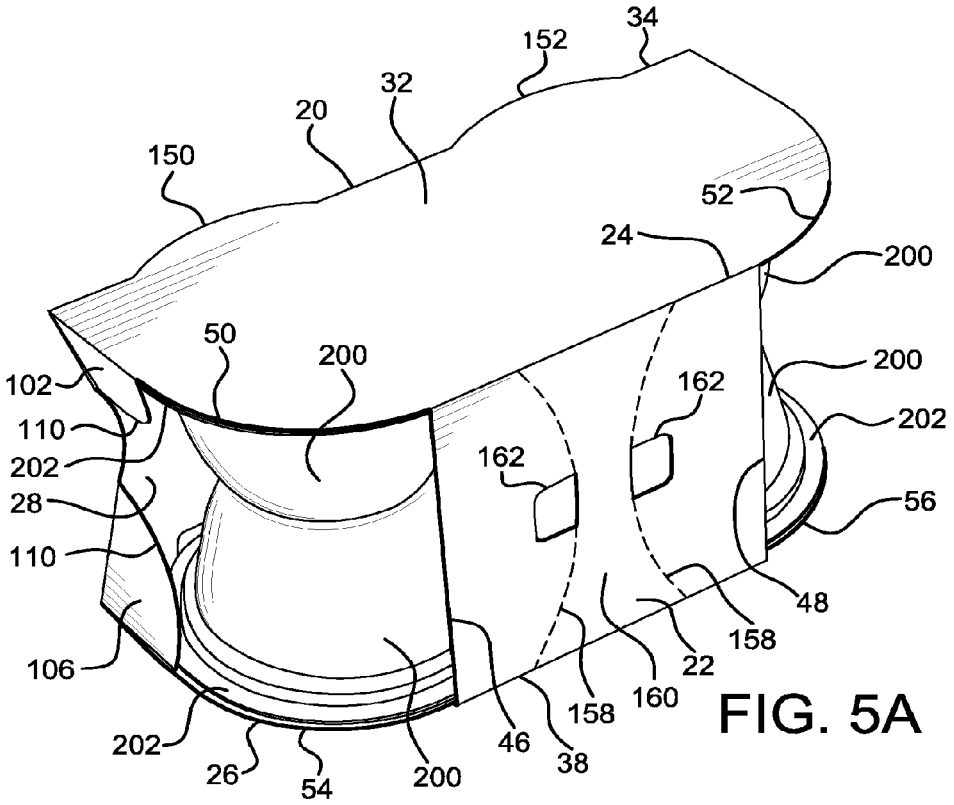
FIG. 5A shows a front elevated view of a 4-cup package enclosure with one glue joint.
Figure 5B:
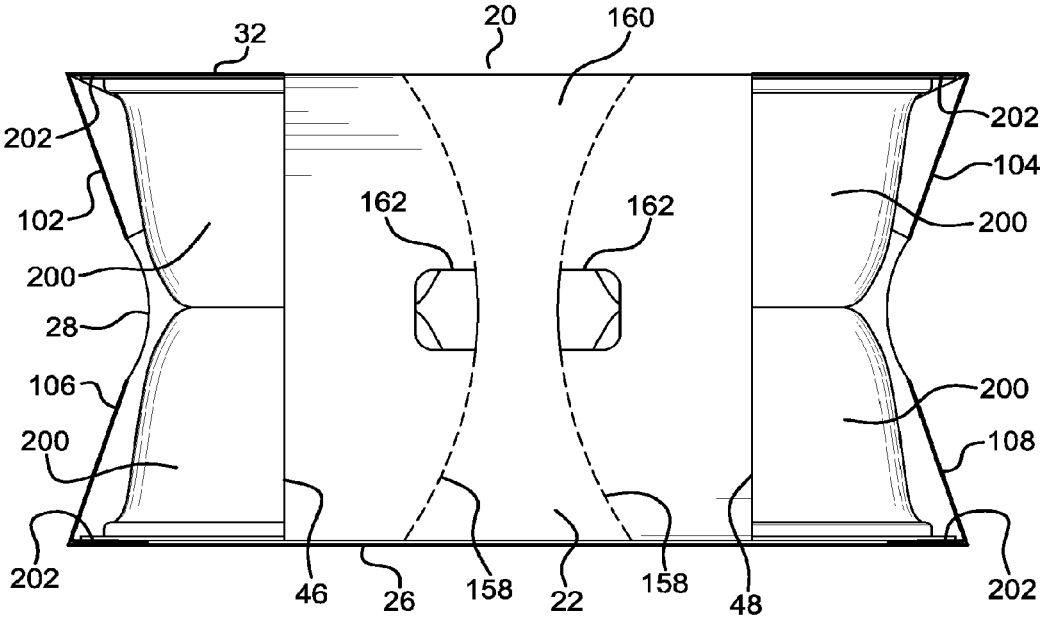
FIG. 5B shows a front view of the 1-glue joint embodiment of FIG. 5A.
Figure 5C:
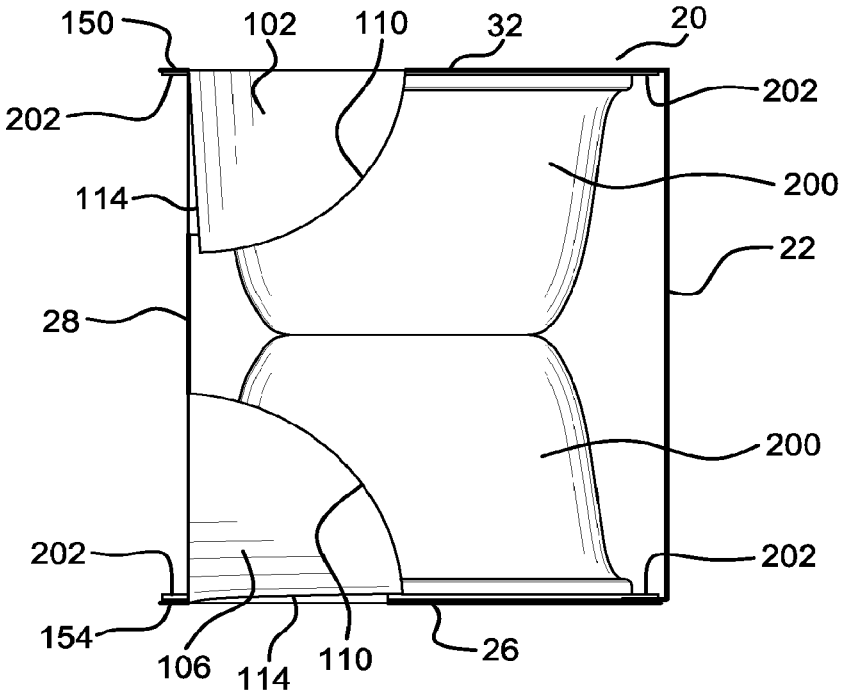
FIG. 5C shows a side view of the 1-glue joint embodiment of FIG. 5A.
Figure 5D:
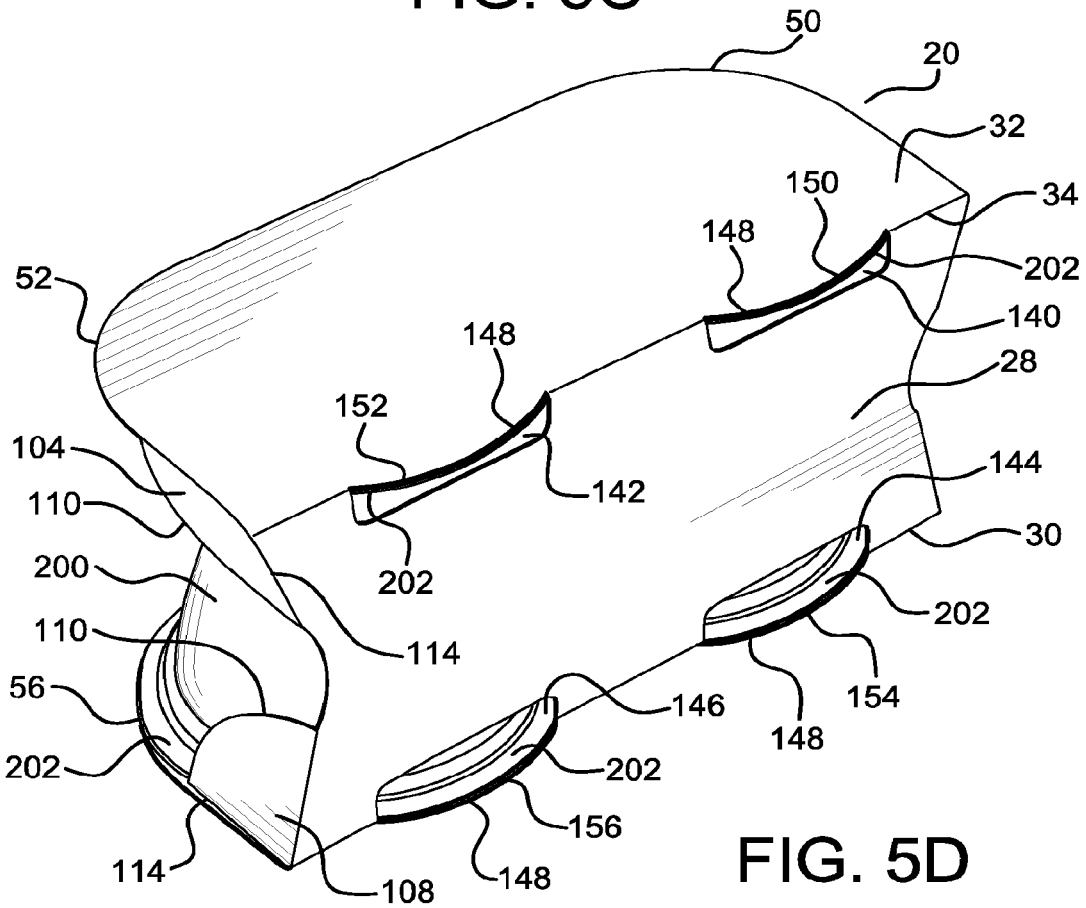
FIG. 5D shows a rear elevated view of the 1-glue joint embodiment of FIG. 5A.
Figure 5E:
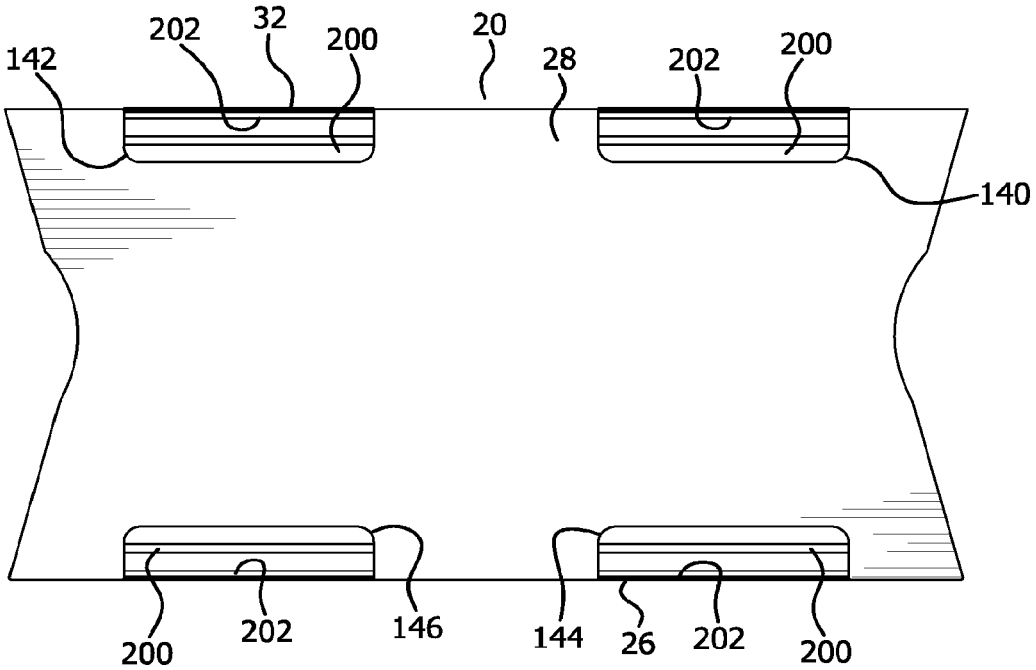
FIG. 5E shows a rear view of the 1-glue joint embodiment of FIG. 5A.
Figure 5F:
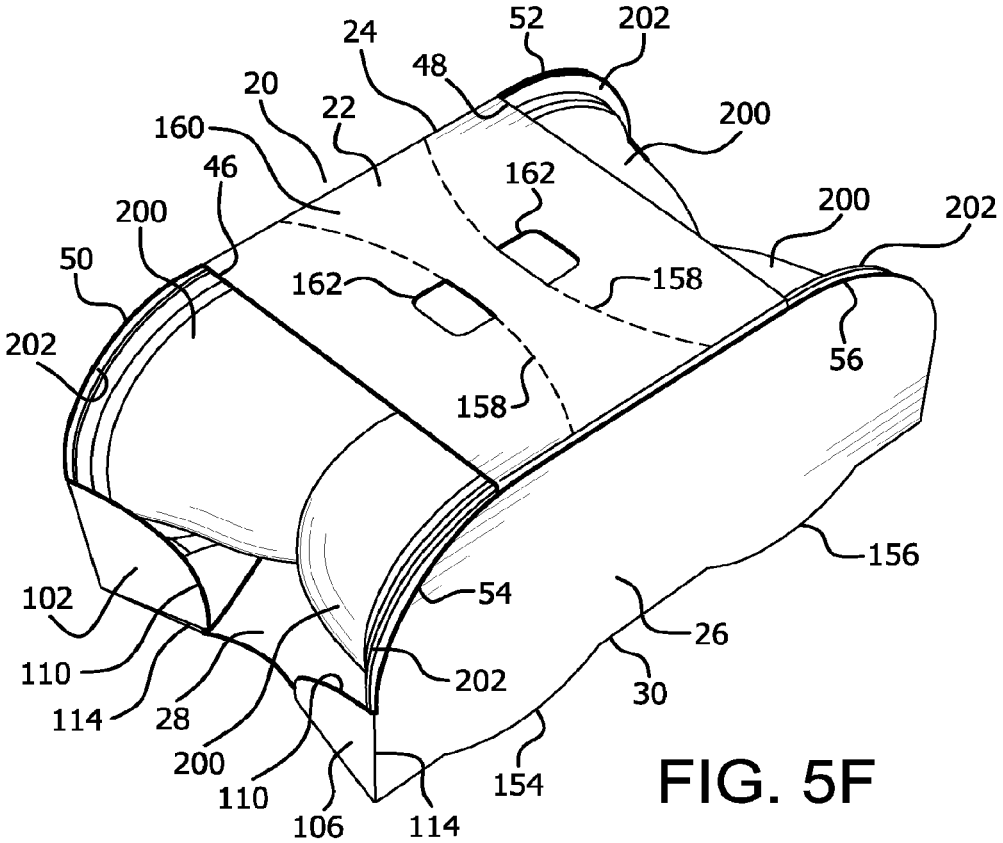
FIG. 5F shows a bottom perspective view of the 1-glue joint embodiment of FIG. 5A.
Figure 5G:
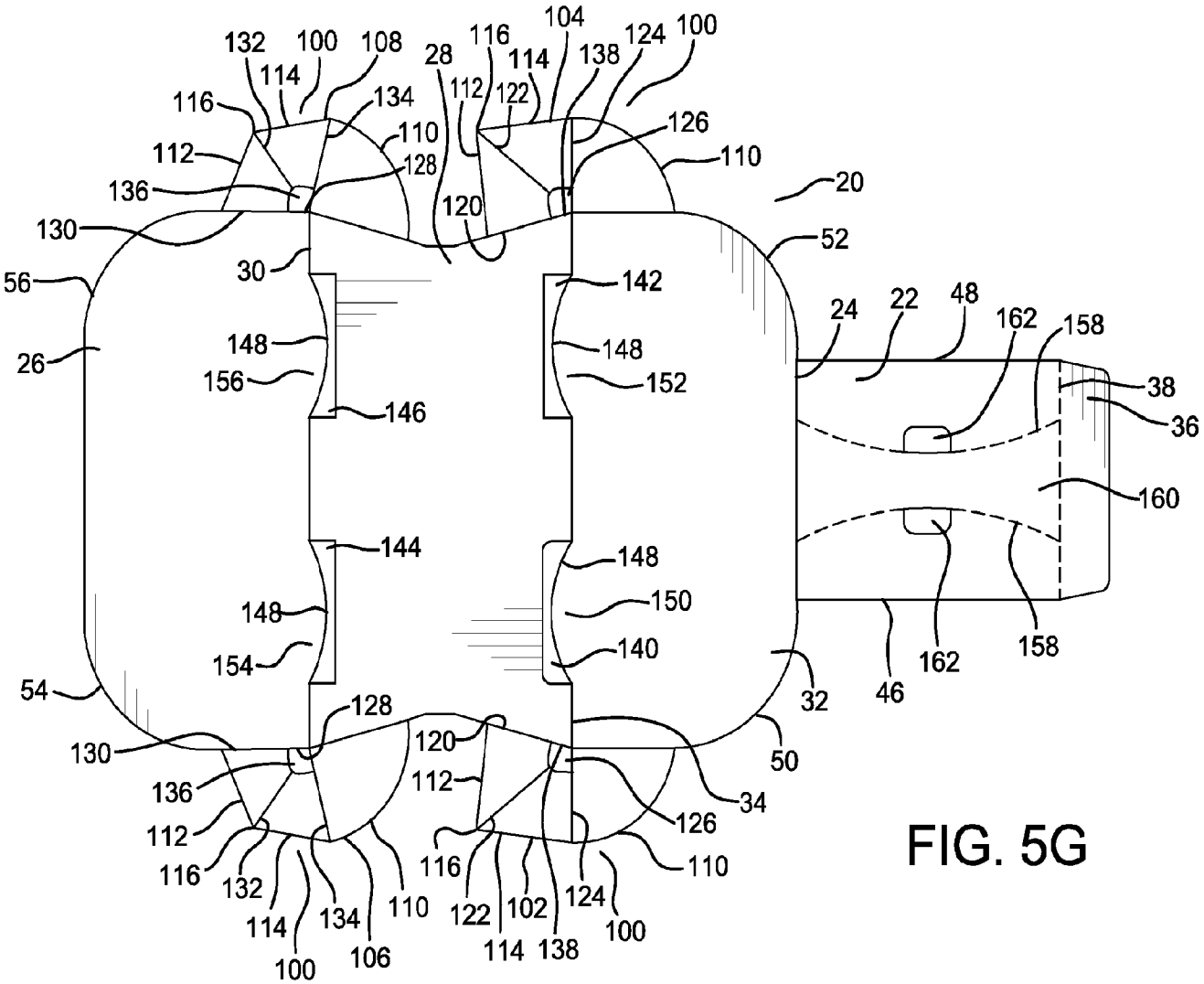
FIG. 5G shows a blank for the 1-glue joint embodiment of FIG. 5A.

Assembled from a unitary blank shown in FIG. 4G—with alternative embodiments of blanks for other four cup enclosures shown in FIGS. 5G (1-glue) and 6G (no-glue)—enclosure 20 comprises front panel 22 contiguous along scored fold line 24 with top panel 32; rear panel 28 contiguous along scored fold line 30 with bottom panel 26; and top panel 32 contiguous along scored fold line 34 with rear panel 28. Tab 36 is provided with front panel 22 to affix the non-contiguous end of front panel 22 to enclosure 20. In an embodiment, tab 36 is affixed to bottom panel 26 with front panel 22 contiguous with top panel 32; while in another embodiment (not shown in the figures), tab 36 is affixed to top panel 32 when front panel 22 is contiguous with bottom panel 26.

Figure 6A:
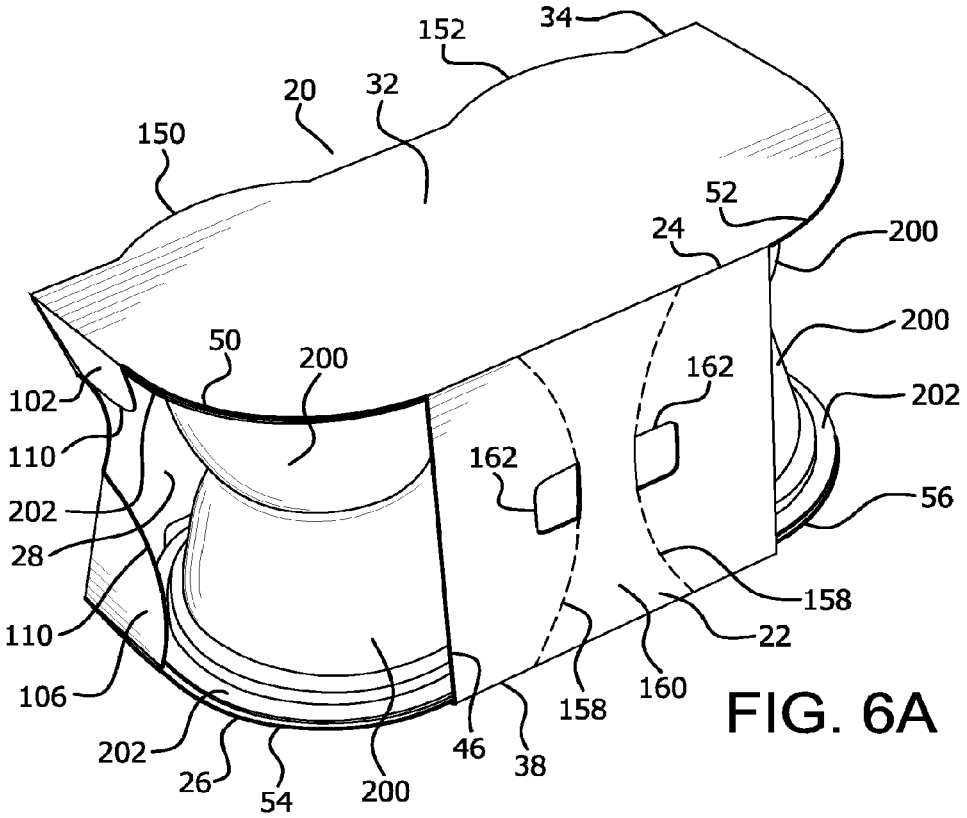
FIG. 6A shows a front elevated view of a 4-cup package enclosure with no glue joints.
Figure 6B:
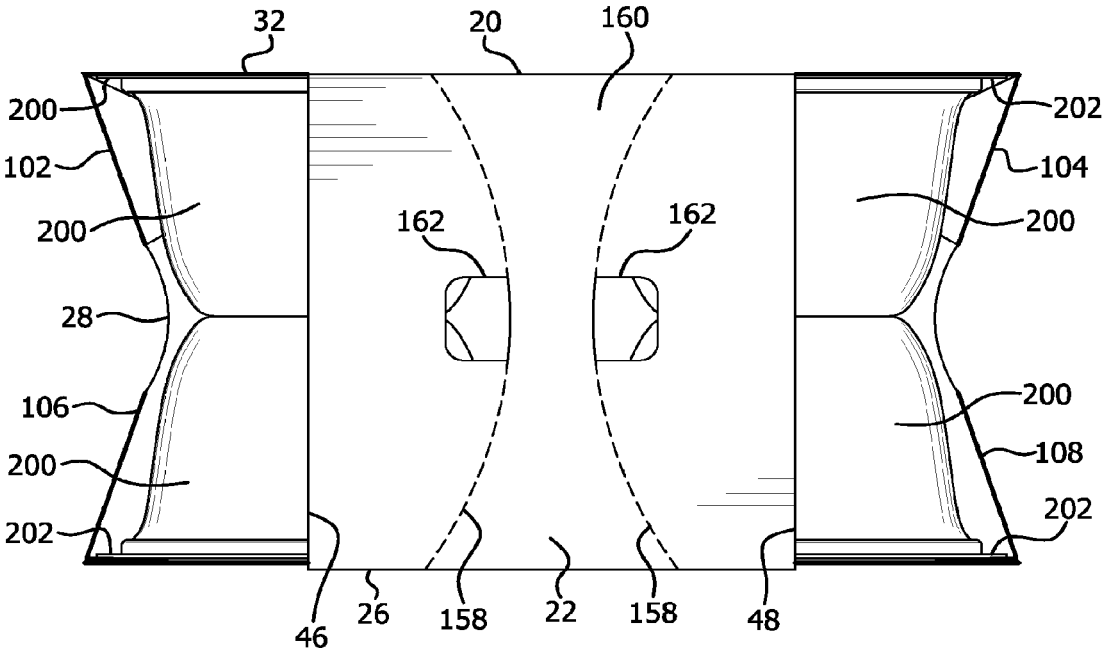
FIG. 6B shows a front view of the no-glue joint embodiment of FIG. 6A.
Figure 6C:
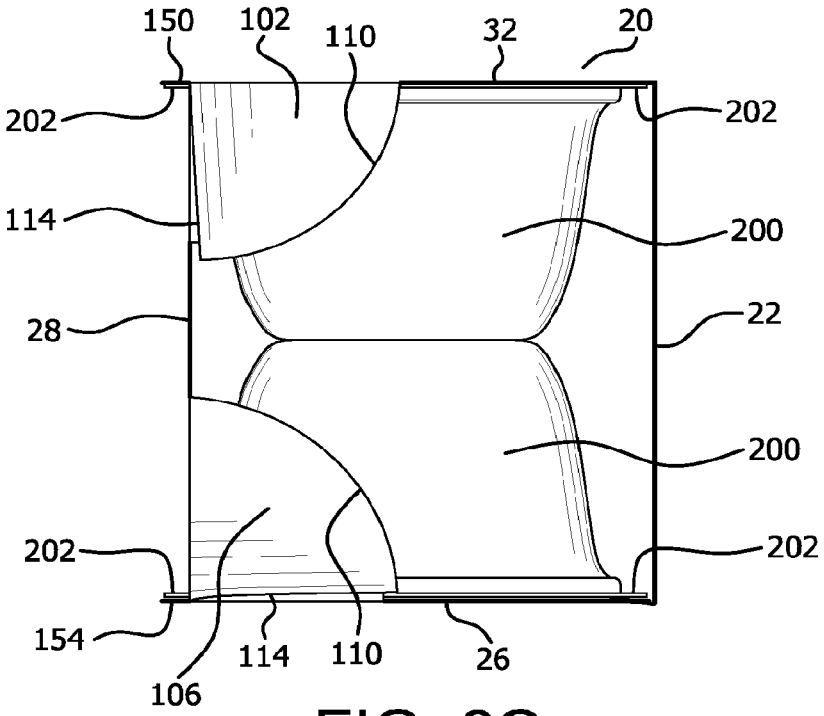
FIG. 6C shows a side view of the no-glue joint embodiment of FIG. 6A.
Figure 6D:
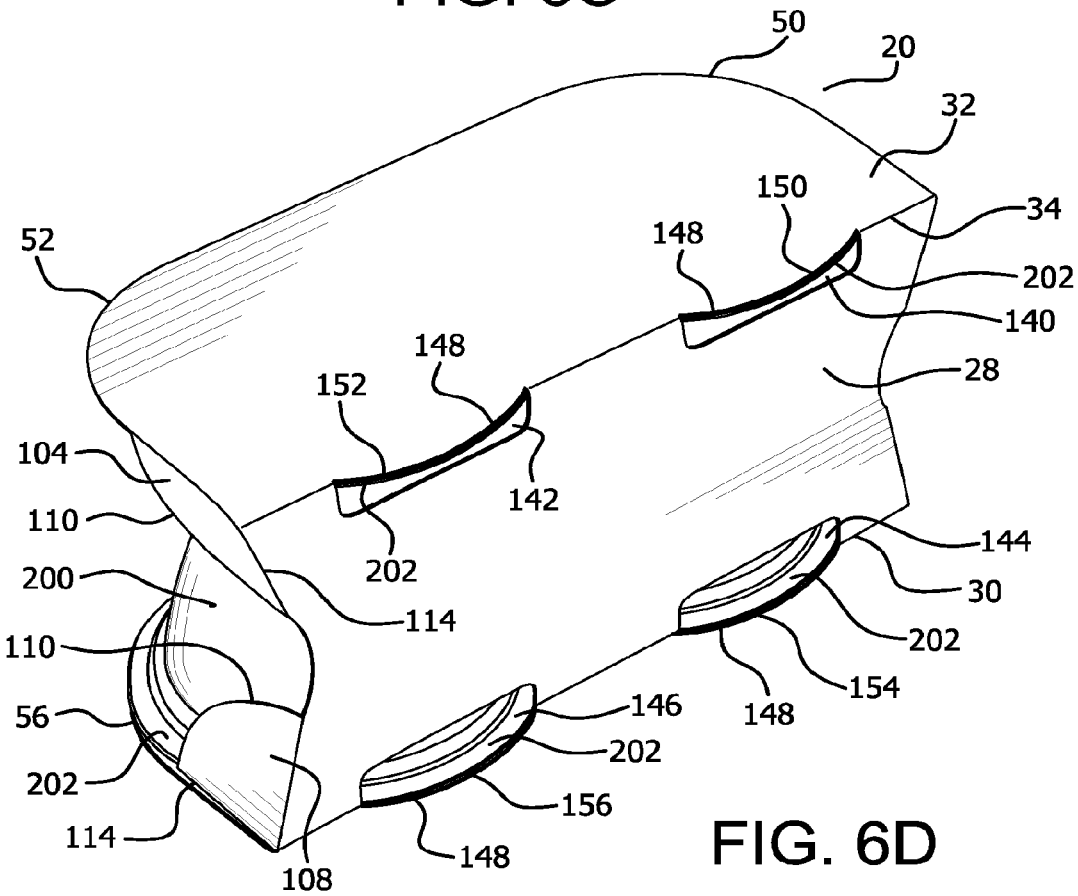
FIG. 6D shows a rear elevated view of the no-glue joint embodiment of FIG. 6A.

As described in further detail later in this disclosure, several embodiments of side closures are provided. FIGS. 4G, 5G, and 6G illustrate blanks for four cup enclosure 20 with various embodiments of the side closures.

In an embodiment, front panel 22 for four cup embodiments—and front panel 222 for two cup embodiments—may be configured as a tear away panel that can be completely removed from enclosure 20 or 220, respectively. This provides access to cups 200 packaged in fully assembled enclosures 20, 220 while the enclosure maintains its storage functionality. This functionality is provided by perforations along two edges formed by scored fold lines 24, 38 shared with front panel 22—or scored fold lines 224, 241 of front panel 222. In an exemplary embodiment shown in FIG. 4G, one edge may be at scored fold line 24 at the juncture between front panel 22 and top panel 32. The other edge is at scored fold line 38 at the juncture between front panel 22 and tab 36 used to affix front panel 22 to bottom panel 26. In an alternative embodiment (not shown in the figures), an edge is at a scored fold line at the juncture between front panel and bottom panel, and the other edge is at a scored fold line at the juncture between front panel and a tab (of the front panel) affixed to the bottom panel.

In a further embodiment of a unitary blank shown in FIG. 5G, front panel 22 may be configured with tear away panels defined by linear or elliptical perforations 158 running from the top to the bottom of front panel 22. The tear away panels may be removed together or individually as needed to allow access to remove cups 200 from enclosure 20. In this embodiment, a portion 160 of front panel 22 remains after the tear away panels are removed. This portion 160 maintains connection between top panel 32 and bottom panel 26. Finger holds 162 may also be provided as communications centrally located through front panel 22 also shown, for example, in FIG. 5F. Finger holds 162 facilitate removal of the tear away panels or assistance in carrying enclosures 20 and 222.

Visual displays are provided with enclosures 20 and 220, as shown for example in FIGS. 4A, 5A, 8A, and 10A. A purpose of the visual displays is to provide viewing access to the contents of cups 200 packaged in enclosure 20 or 220. Specifically, the visual displays permit viewing of at least one quadrant or more of a circumference of each cup 200. The visual displays comprise two curved planer openings as shown in the various views of FIGS. 4A, 5A, 8A, and 10A, configured to replace the two front vertical edges typical for a standard rectangular box-like configuration. Curved planer openings are adjacent to and defined in part by two vertical edges 46, 48 of front panel 22 of enclosure 20 and front panel 222 of enclosure 220. Concentric curvilinear edges 50, 52 of top panel 32 (and of top panel 232 of enclosure 220) and concentric curvilinear edges 54, 56 of bottom panel 26 (and of bottom panel 226 of enclosure 220) provide further definition to curved planer openings. Edges of side closures in their various embodiments also define curved planer openings of enclosures 20 and 220. In certain embodiments of enclosure 20, concentric curvilinear edges 50, 54 and 52, 56 may be substantially aligned along a vertical axis of enclosures 20 and 220. And, in other embodiments, curvilinear edges may be offset from one another, but concentric.

An alternative embodiment of visual displays is shown in FIGS. 11A-11F. These visual displays also comprise two curved planer openings. The curved planer openings are adjacent to and defined in part by two curvilinear vertical edges of front panel 222 and rear panel 228 of enclosure 220. The side edges of top panel 232 and bottom panel 226 provide further definition to curved planer openings of enclosure 220 shown in FIGS. 11A-11F.

Referring now generally to FIGS. 4A-I, 5A-G, and 6A-G, various embodiments of side closures are provided with enclosure 20 and also enclosure 220 as shown in FIGS. 8A-G and 10A-G. These enclosures may be assembled with, and referred to generally as, a 5-glue joint embodiment, a 3-glue joint embodiment (2 cup enclosure 220), a 1-glue joint embodiment, and a no-glue joint embodiment as described throughout this application. The number of glue joints refers to the amount of glue or adhesive contacts needed to assemble enclosures 20 and 220 with their various embodiments of side closures. A purpose of side closures is to provide structural support to enclosure 20 and 220. Another purpose is to assist in securing cups 200 within enclosure 20 and 220.

In an embodiment of a 5-glue joint enclosure 20 shown in FIGS. 4A-4I, two side closures 40 are provided at opposite ends of rear panel 28. Side closures 40 are contiguous with rear panel 28 along scored fold line 58, and fold inward at an angle of about 90 degrees to rear panel 28. Equal to about as tall as rear panel 28, each side closure 40 comprises upper foldable tabs 60, 62 having scored fold lines 61, 63, respectively, along a top edge and lower foldable tabs 64, 66 having scored fold lines 65, 67 along a bottom edge of each side closure 40. A surface of foldable tabs may be affixed with glue or other adhesive agent at four separate glue joints to corresponding top surfaces or bottom surfaces of top panel 32 and bottom panel 26. The fifth glue joint is located between tab 36 of front panel 22 and bottom panel 26, or alternatively, top panel 32, of enclosure 20 depending on the configuration of front panel used.

In an embodiment of a 1-glue joint enclosure shown in FIGS. 5A-5G, side closures are provided as a pair of upper closures 102, 104 that are contiguous with top panel 32 and rear panel 28 at opposite ends of enclosure 20. A pair of lower closures 106, 108 that are contiguous with rear panel 28 and bottom panel 26 are also provided at opposite ends of enclosure 20. In general, the side closures comprise foldable panels having curvilinear edge 110 and two linear edges 112, 114 meeting at point 116 with an angle that is equal to, greater than, or less than about 90 degrees. The foldable panels have three scored fold lines, which optionally may be perforated, for ease in automatic folding. With upper closures 102, 104, scored fold lines 120, 122, 124 extend away from apertures 126 defined, in part, by edges 138 at opposite ends of rear panel 28. And with lower closures 106, 108, scored fold lines 130, 132, 134 extend away from apertures 136, defined, in part, by the edges 128 at opposite ends of bottom panel 26. In this embodiment of the side closures, the scored fold lines establish three panels that fold accordion-like such that side closures fold inward into enclosure 20 and substantially under top panel 32. When folded, upper closures 102, 104 contact rear panel 28, but are not affixed to it. When folded, lower closures 106, 108 are configured to contact bottom panel 26, but are not affixed to it. The side closures are held in place by cups 200 packaged in enclosure 20. In an alternative embodiment, side closures may be affixed with glue or adhesive to enclosure 20. In either embodiment, apertures 126, 136 prevent unneeded overlap of material at the apex of the accordion-like folds of each of the four side closures. The single glue joint is located between tab 36 of front panel 22 and bottom panel 26, or alternatively, top panel 32, of enclosure 20 depending on the configuration of front panel used.

An embodiment of a no-glue joint enclosure shown in FIGS. 6A-6G. This no-glue joint embodiment is similar to the 1-glue joint embodiment of FIGS. 5A-5G with one modification. The tab 36 (of the 1-glue joint embodiment) is configured as a lock tab 600 as shown specifically in FIG. 6G. Also, a slit 602 provides a communication through bottom panel 26. The slit 602 is configured to receive and secure lock tab 600 such that front panel 22 is attached to bottom panel 26 of enclosure 20. In an alternative embodiment with front panel 22 contiguous with bottom panel 26, slit 602 provides a communication through top panel 32 so that lock tab 600 can be inserted into slit 602 to secure front panel 22 to top panel 32.

As shown in FIGS. 4A-6G for the four cup enclosures, enclosure 20 may comprise upper slots 140, 142 provided in rear panel 28. The slots have a height and length configured to receive a portion of the top circumferential edge 202 of cups 200 which partially extend beyond rear panel 28. The slots assist in securing cups 200 within enclosure 20. Two pairs of slots are provided with embodiments of the four cup enclosure of the invention. Alternatively, no slots are provided and edge 202 of cups 200 do not extend beyond rear panel 28. One pair of upper slots 140, 142 are aligned horizontally in rear panel 28 and along scored fold line 34 at the edge of top panel 32 and rear panel 28. Another pair of lower slots 144, 146 are aligned horizontally in rear panel 28 and along scored fold line 30 at the edge of rear panel 28 and bottom panel 26. Lower slots 144, 146 perform the same function as the upper slots 140, 142.

Figure 4H:
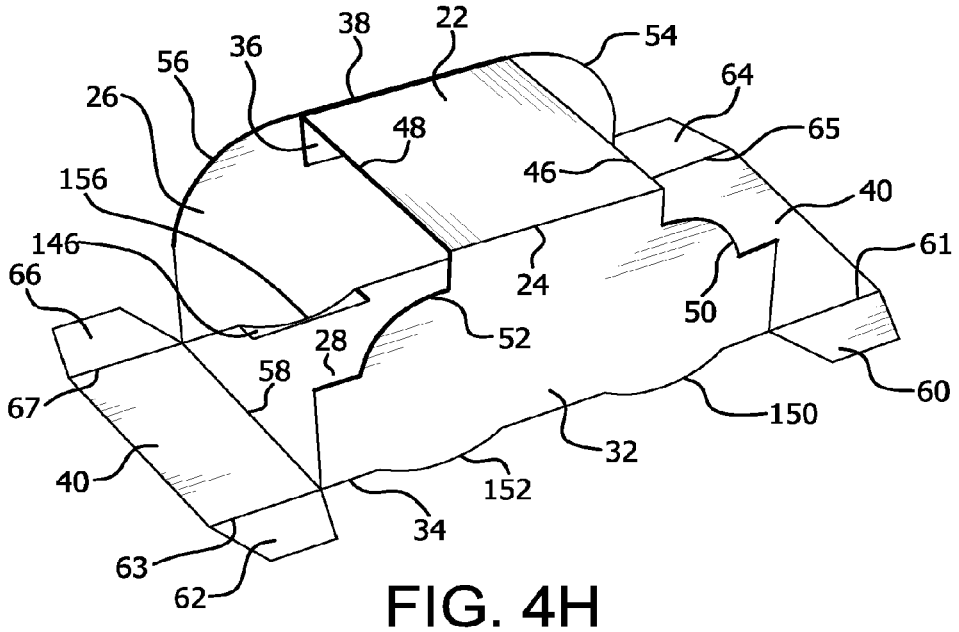
FIG. 4H shows an assembly step of the 5-glue joint package enclosure similar to that of FIG. 4A showing the front panel attached to the bottom panel.
Figure 4I:
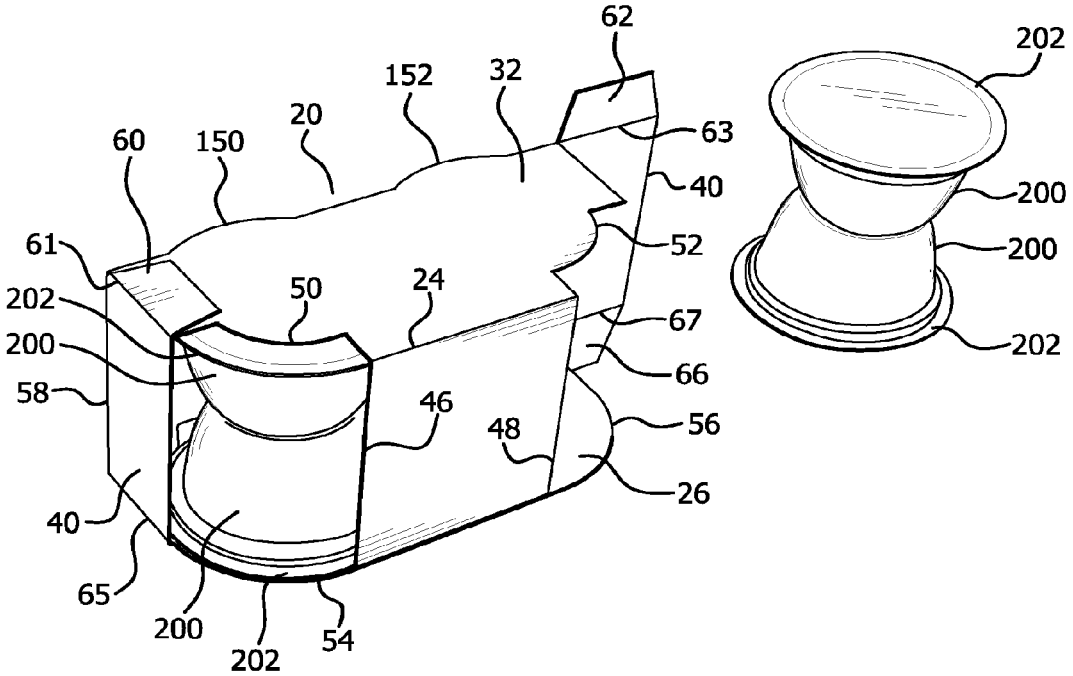
FIG. 4I shows a further assembly step of the 5-glue joint package enclosure of FIG. 4H with one set of cups secured within the enclosure.
Figure 6E:
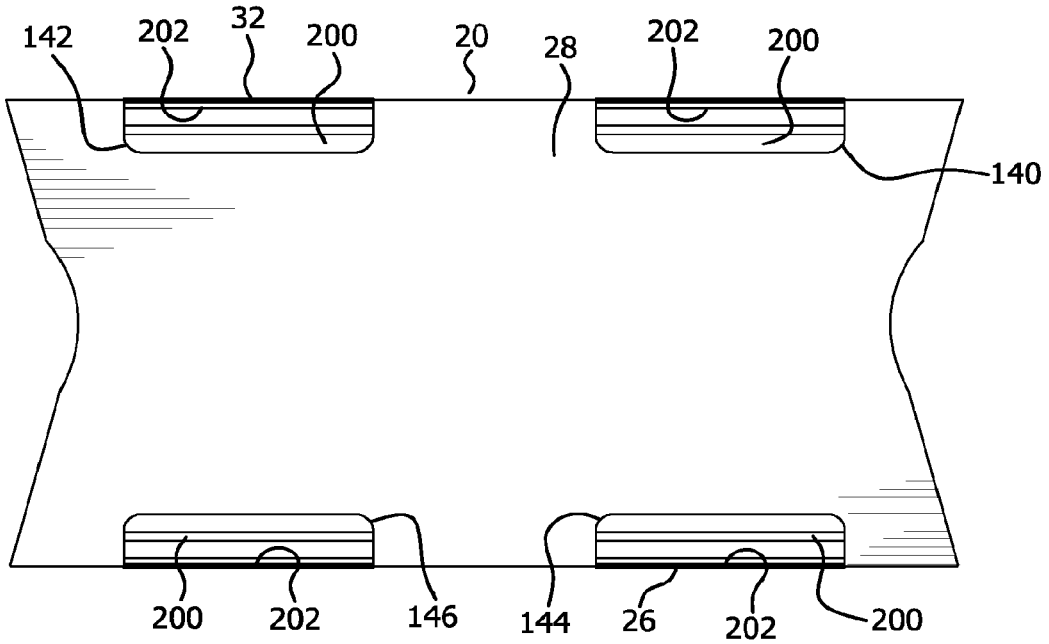
FIG. 6E shows a rear view of the no-glue joint embodiment of FIG. 6A.
Figure 6F:
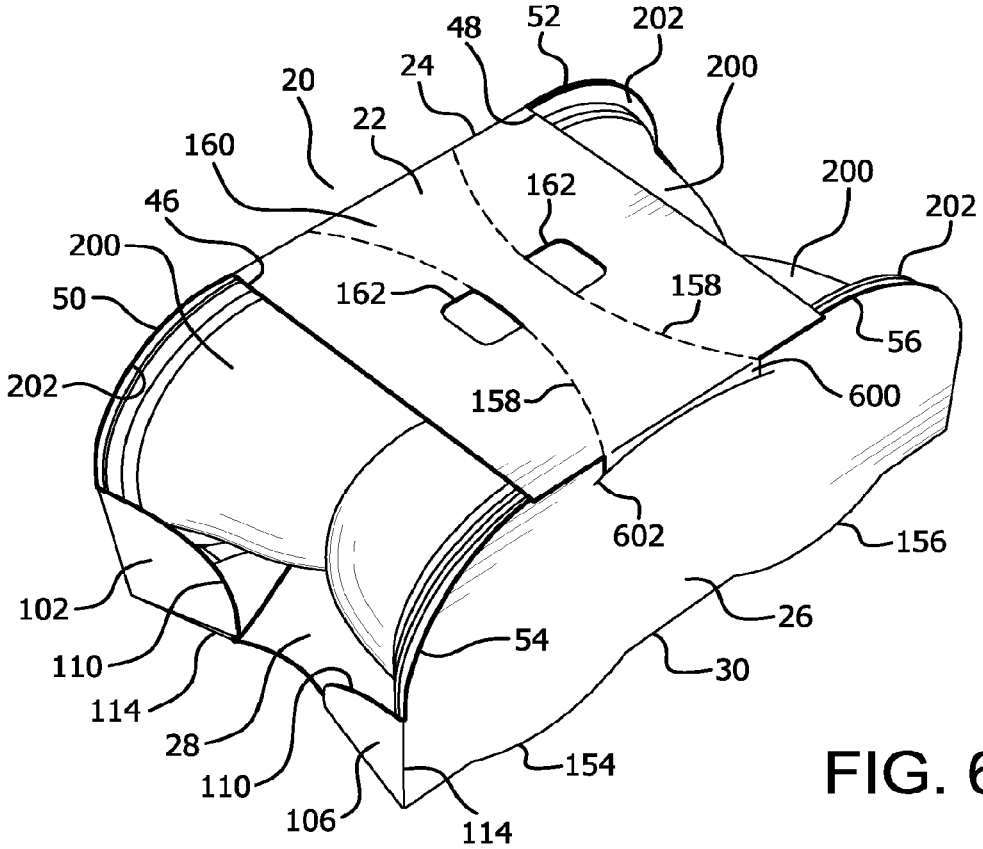
FIG. 6F shows a bottom perspective view of the no-glue joint embodiment of FIG. 6A.
Figure 6G:
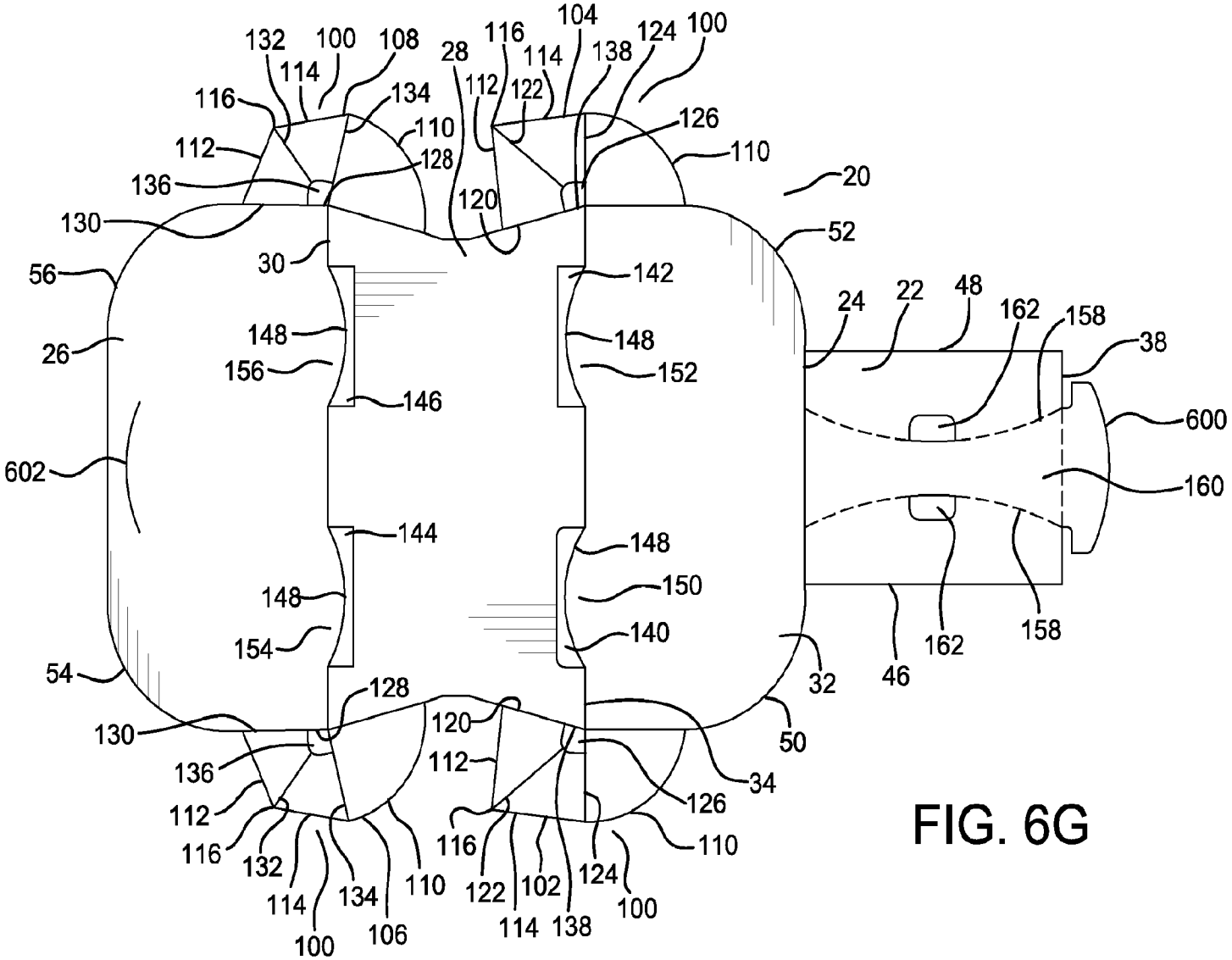
FIG. 6G shows a blank for the no-glue joint embodiment of FIG. 6A.

While the slots comprise a substantially rectangular configuration in assembled enclosures as shown, for example, in FIGS. 4E, 5E, and 6E, the unitary blanks of enclosure 20 show an elliptical edge 148 provided along one edge of each slot as shown in FIGS. 4G, 5G, and 6G. In upper slots 140, 142, elliptical edges 148 define curvilinear projections 150, 152 along top panel 32 that will project away from an assembled enclosure 20 shown, for example, in FIGS. 4A, 5A, and 6A at about a 90 degree angle from rear panel 28. In lower slots 144, 146, elliptical edges 148 also define curvilinear projections 154, 156 along bottom panel 26 that will project away from assembled enclosure 20 shown, for example, in FIGS. 4A, 5A, and 6A at about a 90 degree angle from rear panel 28. The curvilinear projections 150, 156 of top panel 32 and the curvilinear projections 154, 156 of bottom panel 26 may have substantially the same, a larger, or a smaller radius of curvilinear edges 50, 52 that are positioned along the front of top panel 32 and curvilinear edges 54, 46 of bottom panel 26. In an embodiment, all of the curvilinear edges of the top panel and the bottom panel have a circumference that is substantially the same circumference as cup edge 202 of cups 200 as shown in FIG. 4A. In another embodiment, curvilinear edges 50, 52 along the front of top panel 32 or curvilinear edges 54, 56 along the front of bottom panel 26 may be offset from one another such that one set of either curvilinear edges have a circumference that is smaller than the circumference of the top of cups 200. This offset configuration is shown in the alternative (FIGS. 4H and 4I) for the 5-glue joint four cup enclosure 20. In a further embodiment, the curvilinear edges along the front of the top panel and the front of the bottom panel may have circumferences that are equal to the circumference of cup edge 202 of cups 200 as shown in FIGS. 5A and 6A.

The invention includes enclosure 220 for packaging two cups 200. Referring now to a two cup embodiment of the invention illustrated in FIGS. 8A-8G, enclosure 220 comprises the shape of a hollow and substantially rectangular polyhedron. There are many similarities between the two cup and four cup embodiments of the invention. Similar features, where present between the two cup and the four cup embodiments, share the same designations in the figures.

Assembled from a unitary blank—with different blank embodiments shown in FIGS. 8G, 9, 10G, and 11F—enclosure 220 comprises front panel 222 contiguous along scored fold line 224 with top panel 232, rear panel 228 contiguous along scored fold line 230 with bottom panel 226, and top panel 232 contiguous along scored fold line 234 with rear panel 228. Front panel 222 includes tab 240 to affix front panel 222 to bottom panel 226. Foldable score line 241 is provided between front panel 222 and tab 240. Alternatively, front panel 222 may be contiguous with bottom panel 226 rather than top panel 232—similar to the embodiments of enclosure 20. Enclosure 220 may be configured with any of the side closure embodiments and visual displays described in connection with four cup enclosure 20 (shown in FIGS. 4A-7) and also including 3-glue joint closures described in further detail later in this application.

Figure 8A:
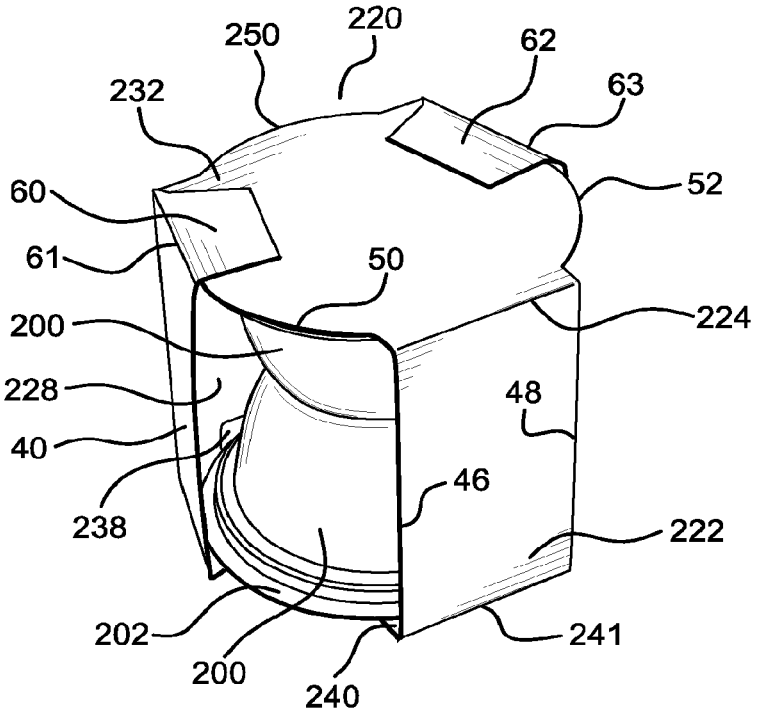
FIG. 8A shows a front elevated view of a 2-cup package enclosure with 5 glue joints.
Figure 8B:
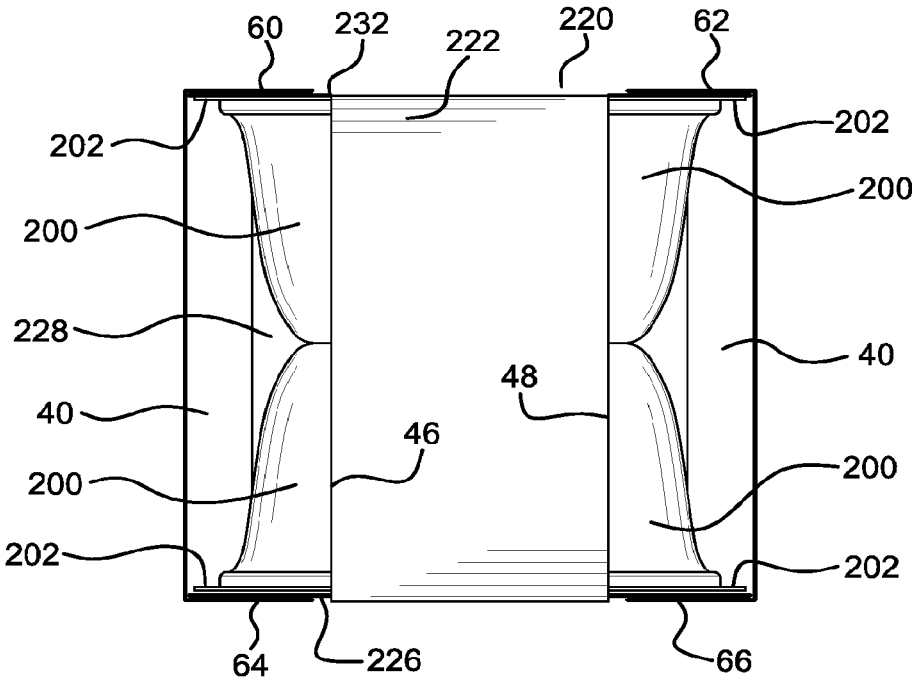
FIG. 8B shows a front view of the 5-glue joint embodiment of FIG. 8A.
Figure 8C:
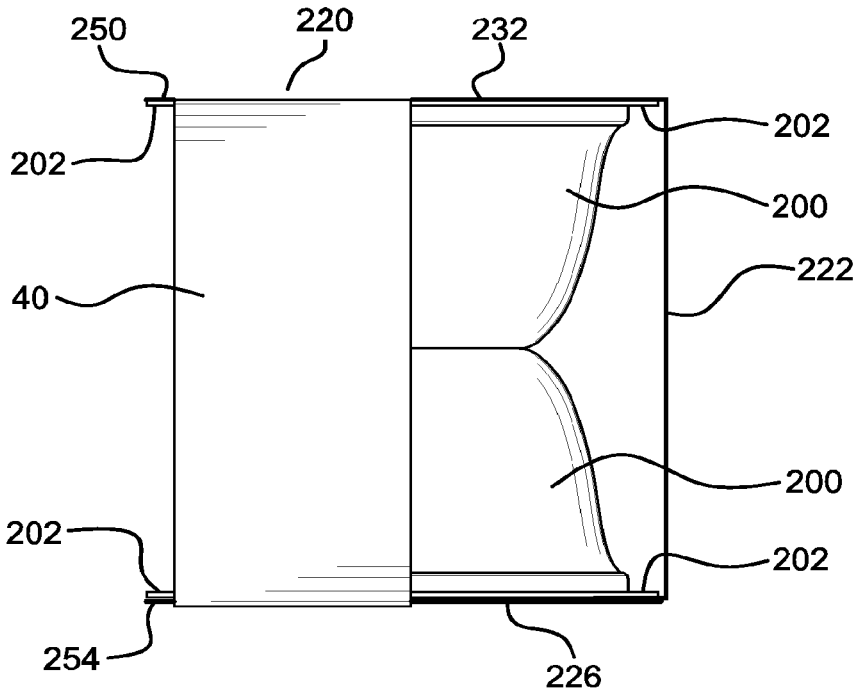
FIG. 8C shows a side view of the 5-glue joint embodiment of FIG. 8A.
Figure 8D:
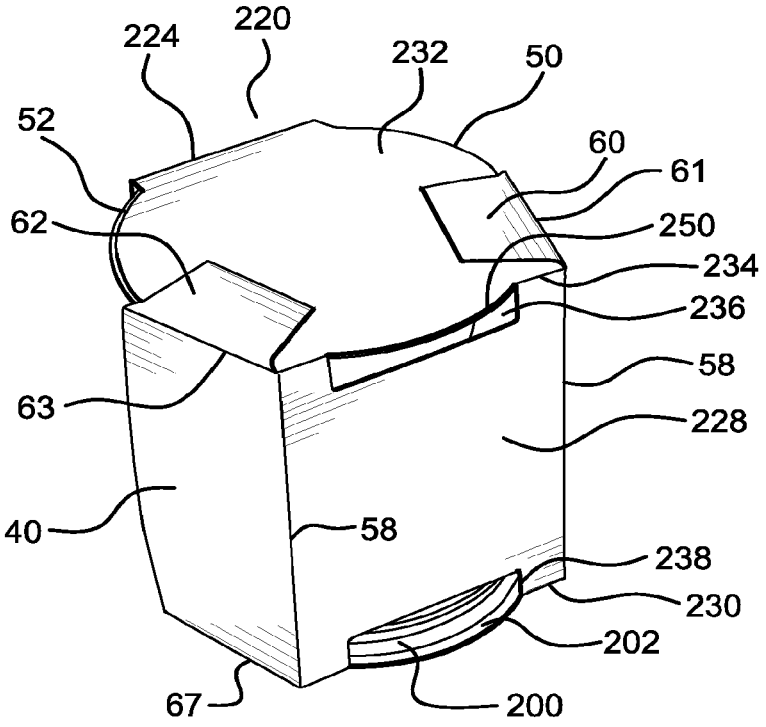
FIG. 8D shows a rear elevated view of the 5-glue joint embodiment of FIG. 8A.
Figure 8E:
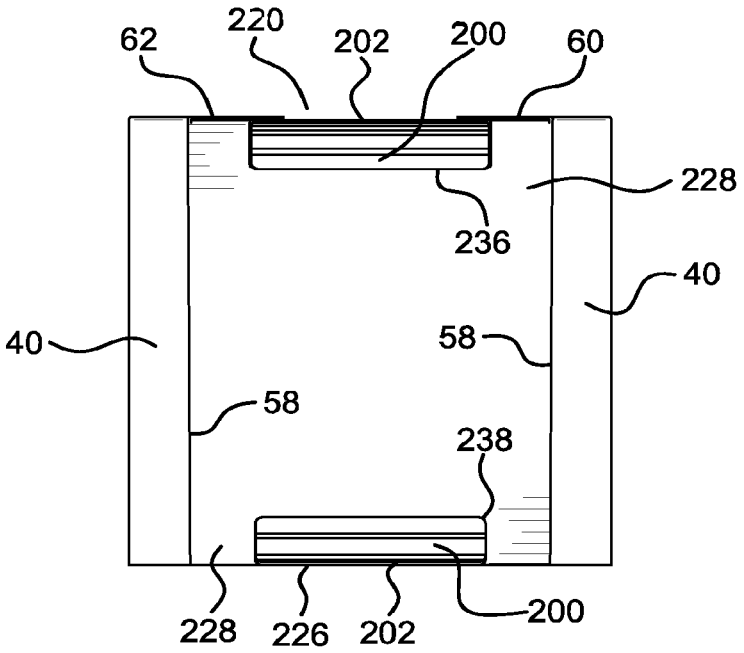
FIG. 8E shows a rear view of the 5-glue joint embodiment of FIG. 8A.
Figure 8F:
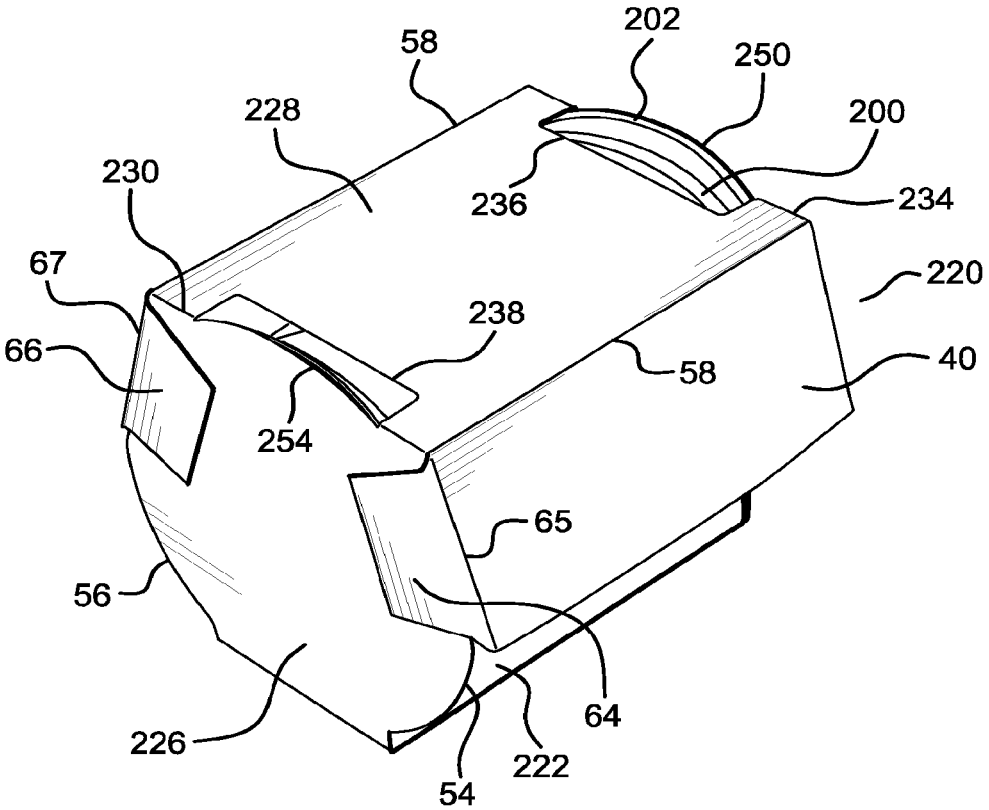
FIG. 8F shows a bottom perspective view of the 5-glue joint embodiment of FIG. 8A.
Figure 8G:
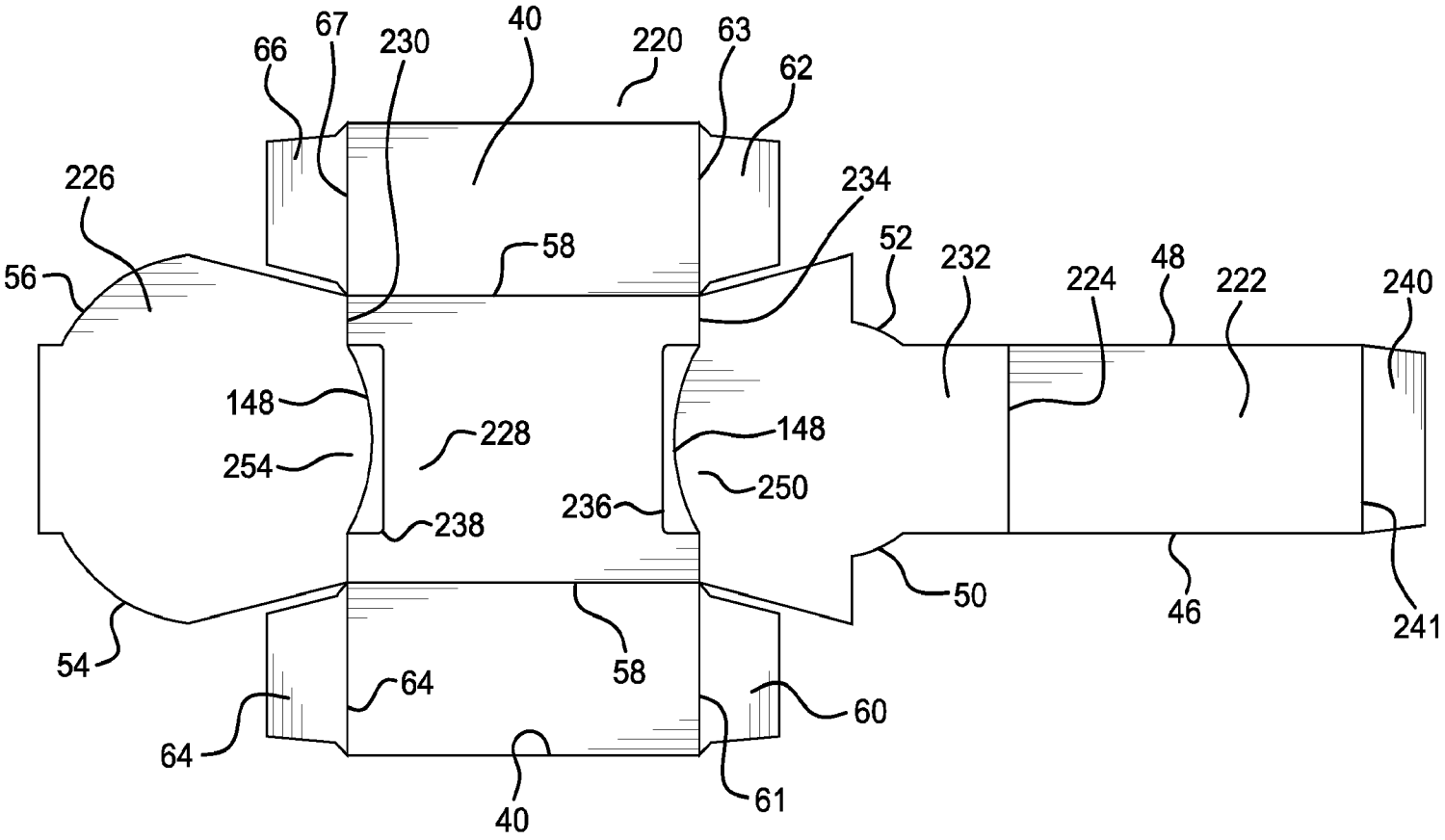
FIG. 8G shows a blank for the 5-glue joint embodiment of FIG. 8A.
Figure 10A:
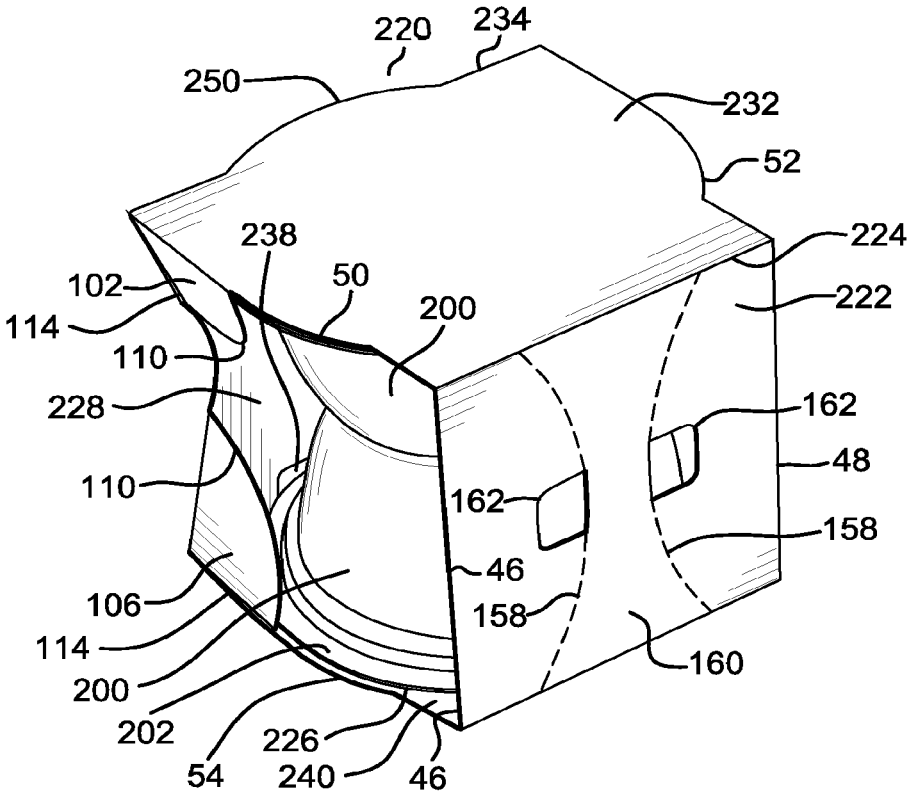
FIG. 10A shows a front elevated view of a 2-cup package enclosure with one glue joint.
Figure 10B:
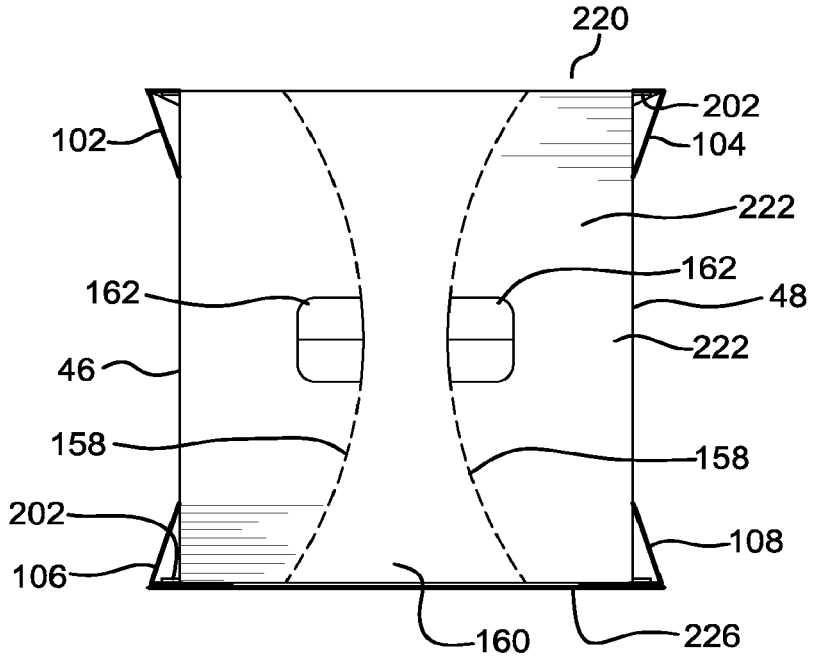
FIG. 10B shows a front view of the 1-glue joint embodiment of FIG. 10A.
Figure 10C:
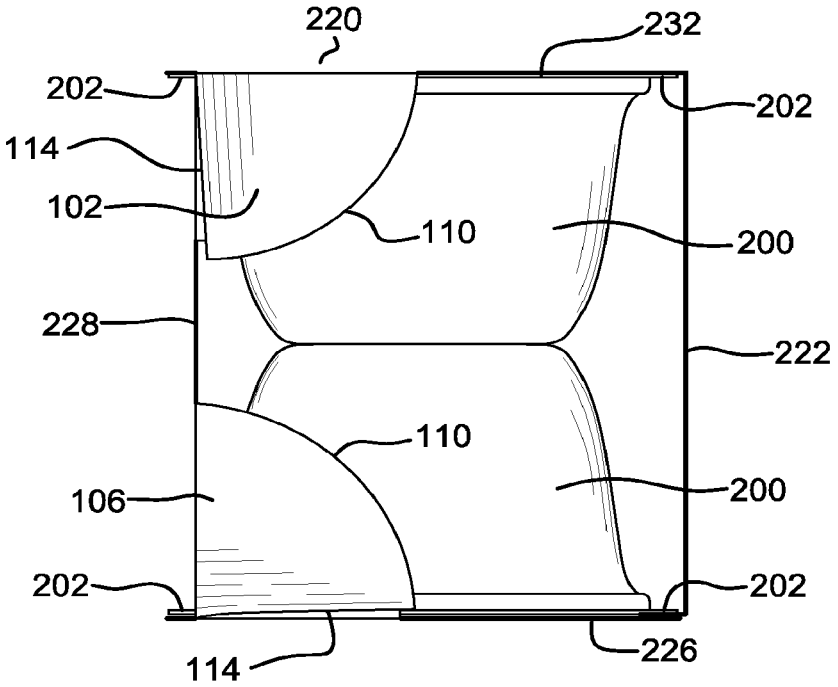
FIG. 10C shows a side view of the 1-glue joint embodiment of FIG. 10A.
Figure 10D:
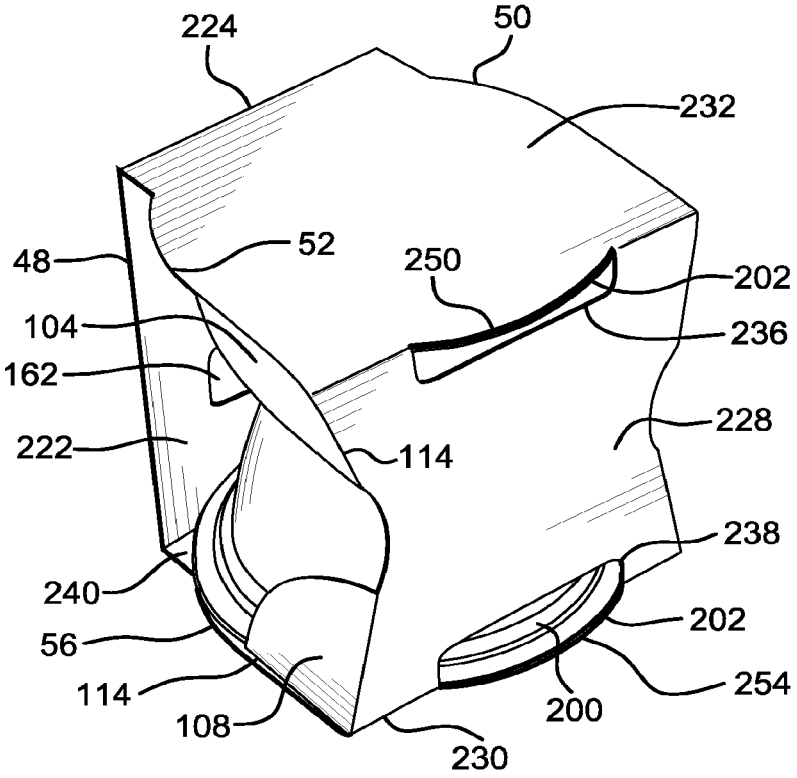
FIG. 10D shows a rear elevated view of the 1-glue joint embodiment of FIG. 10A.
Figure 10E:
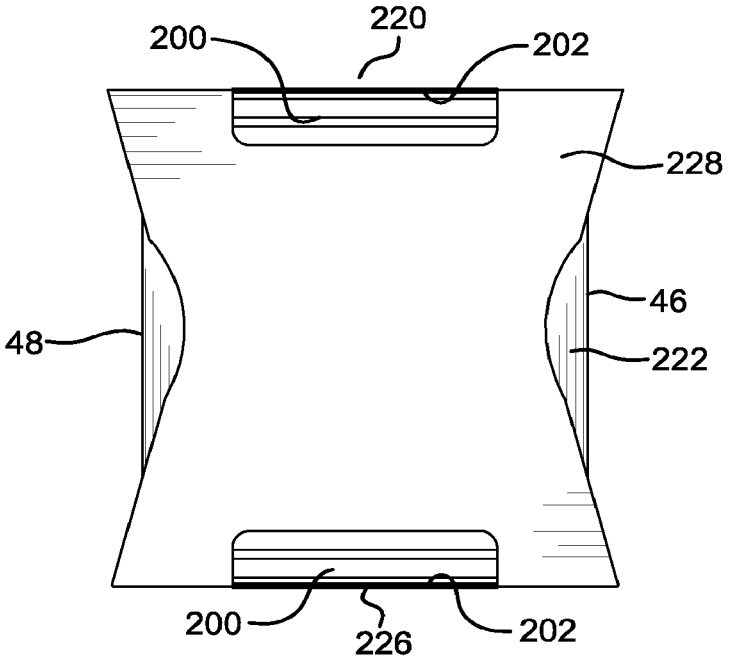
FIG. 10E shows a rear view of the 1-glue joint embodiment of FIG. 10A.
Figure 10F:
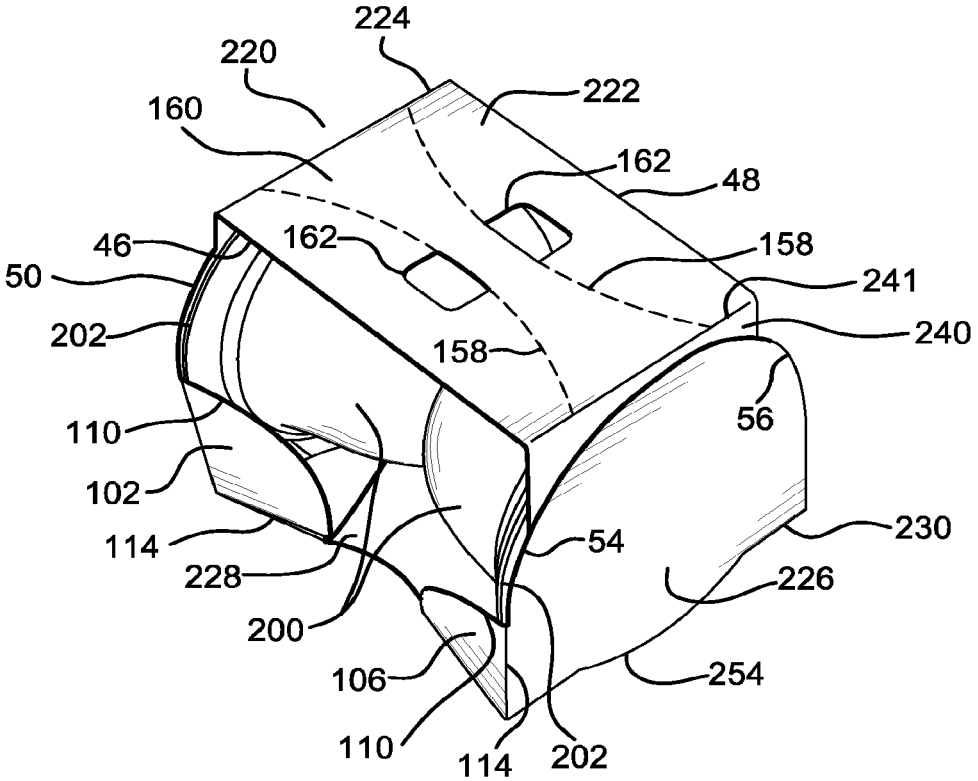
FIG. 10F shows a bottom perspective view of the 1-glue joint embodiment of FIG. 10A.
Figure 11A:
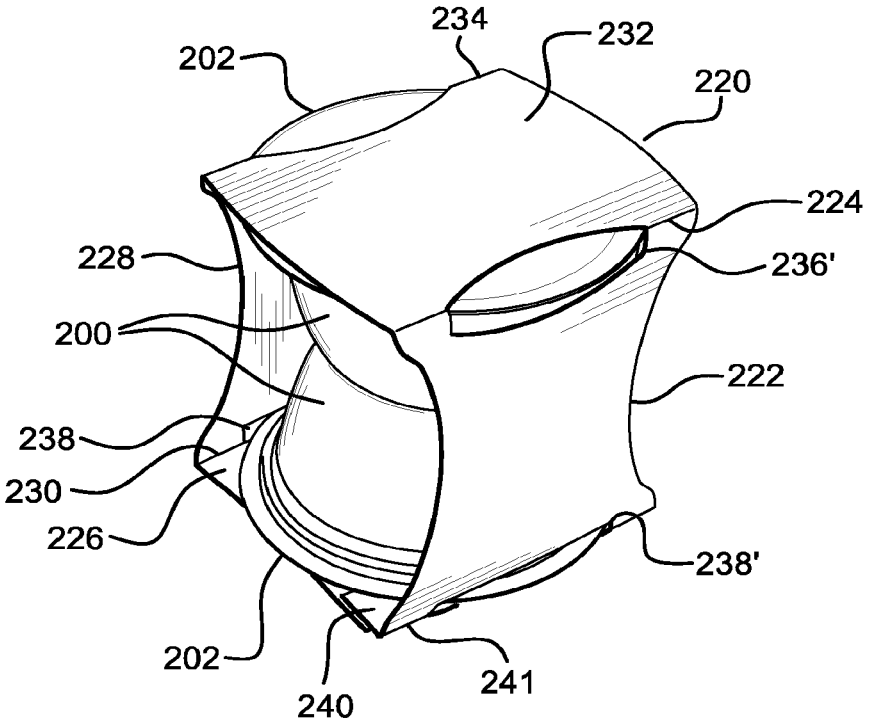
FIG. 11A shows a front elevated view of an alternative 2-cup package enclosure with one glue joint.
Figure 11B:
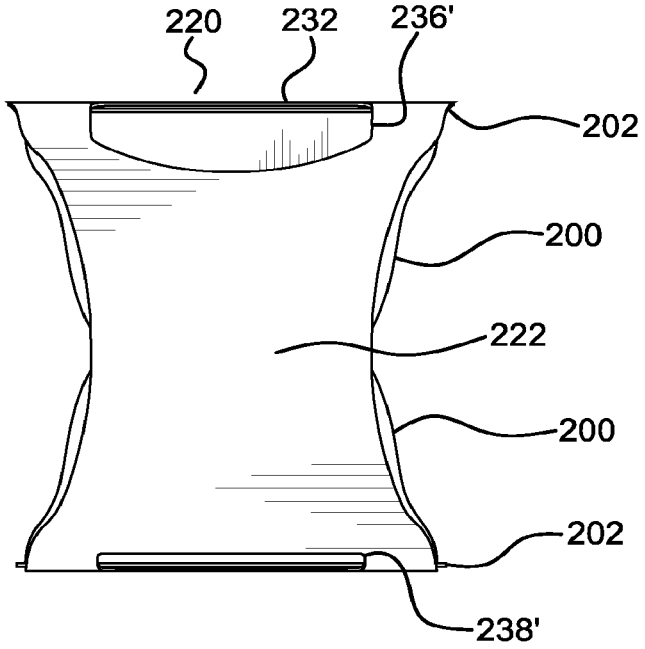
FIG. 11B shows a front view of the 1-glue joint embodiment of FIG. 11A.
Figure 11C:
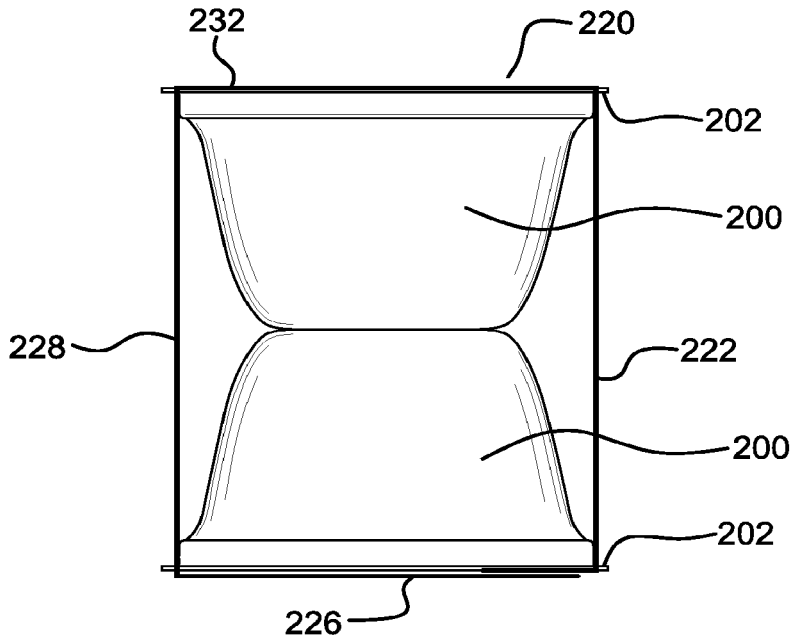
FIG. 11C shows a side view of the 1-glue joint embodiment of FIG. 11A.
Figure 11D:
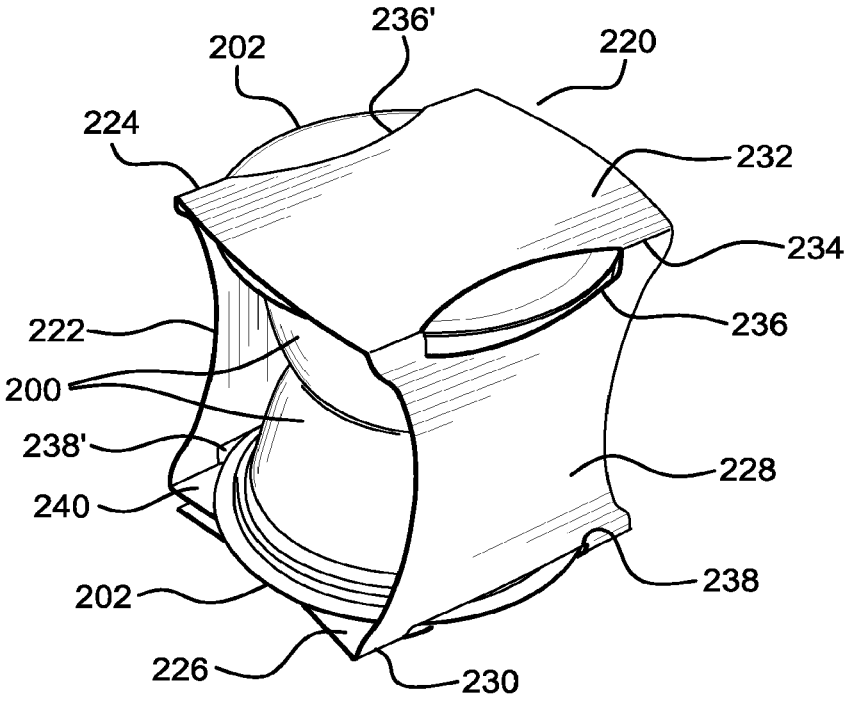
FIG. 11D shows a rear elevated view of the 1-glue joint embodiment of FIG. 11A.
Figure 11E:
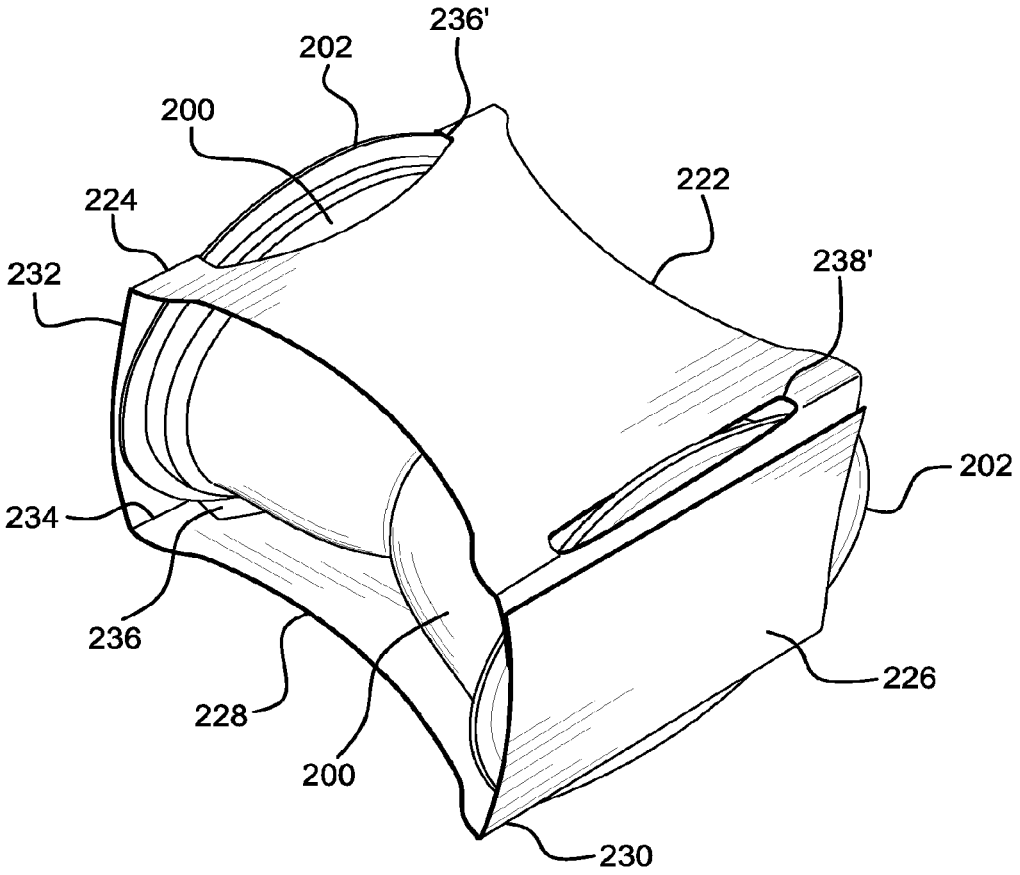
FIG. 11E shows a bottom perspective view of the 1-glue joint embodiment of FIG. 11A.

The differences between two cup and four cup embodiments of the invention are described in further detail. One is that the two cup embodiment comprises enclosure 220 that is narrower in width than enclosure 20 of the four cup embodiment. Another difference is that the two cup embodiment has one pair of slots—upper slot 236 (or 236' in FIG. 11F) and lower slot 238 (or 238' in FIG. 11F)—rather than the two pairs of slots provided with the four cup embodiment. As shown in FIGS. 8E, 10E, and 11E, upper slot 236 (or 236' in FIGS. 11D and 11F) is provided in rear panel 228 and generally aligned along scored fold line 234 at the edge of top panel 232 and rear panel 228. Lower slot 238 (or 238' in FIGS. 11E and 11F) is also provided in rear panel 228 and generally aligned along scored fold line 230 at the edge of rear panel 228 and bottom panel 226. Referring now to FIGS. 8E, 10E, and 11E, upper projection 250 and lower projection 254 extend away from rear panel 228 along elliptical edge 148 at about 90 degrees. The two cup embodiment of FIGS. 11A-11F has slots 236' and 238' lacking any projections from enclosure 20.

Aside from these differences, the remaining features of two cup enclosure 220 and its various embodiments, such as, for example, the embodiments of the side closures, the tear away features of front panel, perforated edges, curvilinear edges, and the like, may be the same as, or similar to, those of four cup enclosure 20 throughout its various embodiments.

In an embodiment, two cup enclosure 220 comprises a 3-glue joint enclosure (with blank shown in FIG. 9), side closures are provided as sets of upper tabs 84, 86, which are contiguous with top panel 232 along scored fold lines 92, 94, and lower tabs 88, 90, which are contiguous with bottom panel 226 along scored fold lines 96, 98. Upper tabs 84, 86 are provided at opposite ends of top panel 232, and lower tabs 88, 90 are provided at opposite ends of bottom panel 226. Upper tabs 84, 86 overlap with corresponding lower tabs 88, 90 such that the overlapping portions may comprise between about ¼ to about ¾ the length that upper tabs 84, 86 extend from top panel 232 or lower tabs 88, 90 extend from bottom panel 226. The overlapping regions provide corresponding surfaces so that upper tabs 84, 86 may be affixed with glue or other adhesive agent to corresponding lower tabs 88, 90 at separate glue joints. Once affixed to one another, corresponding upper tabs 84, 86 and lower tabs 88, 90 establish side closures with a height that is equal to about the height of rear panel 228 and front panel 222. The third glue joint is located between tab 36 of front panel 222 and bottom panel 226, or alternatively, top panel 232, of enclosure 220 depending on the configuration of front panel used.

In an embodiment of another two cup enclosure 220, an alternative 3-glue joint configuration may be used. In this embodiment, side closures are provided as single panels contiguous with top panel 232 along scored fold lines. In this configuration, single panels comprise a foldable tab at the end opposite scored fold lines. Foldable tabs may be affixed with glue or other adhesive to a top surface or a bottom surface of bottom panel 226 at glue joints. In an alternative configuration, the single panels are contiguous with the bottom panel along scored fold lines. In this instance, each side panel comprises a foldable tab at the end opposite the scored fold line and may be used to affix with glue or other agent each panel to the top surface or bottom surface of the top panel. In either configuration of this embodiment, side closures have a height that is equal to about the height of rear panel 228 and front panel 222. The third glue joint is located between tab 240 of front panel 222 and bottom panel 226, or alternatively, top panel 232, of enclosure 220 depending on the configuration of front panel used.

Referring now to FIGS. 11A-11F, another embodiment of a 2-cup enclosure 220 is provided. This embodiment provides similar features of the other 2-cup embodiments with the exception of side closures and slot configurations and projections.

The unitary enclosures 20 and 220 of the invention may be comprised of material stock 500 such as, for example, paperboard stock, corrugated fiberboard, plastic film material—rigid or flexible, clear or opaque, etc. The glue joints—for example, tab 36 of front panel 22, may be affixed with a suitable adhesive agent, such as for example, glue, locks (lock tab 600 & slit 602), tape, and the like. The material stock 500 may be prepared in a manner that allows for the printing of various logos, package designs, nutritional information, and the like.

Figure 9:
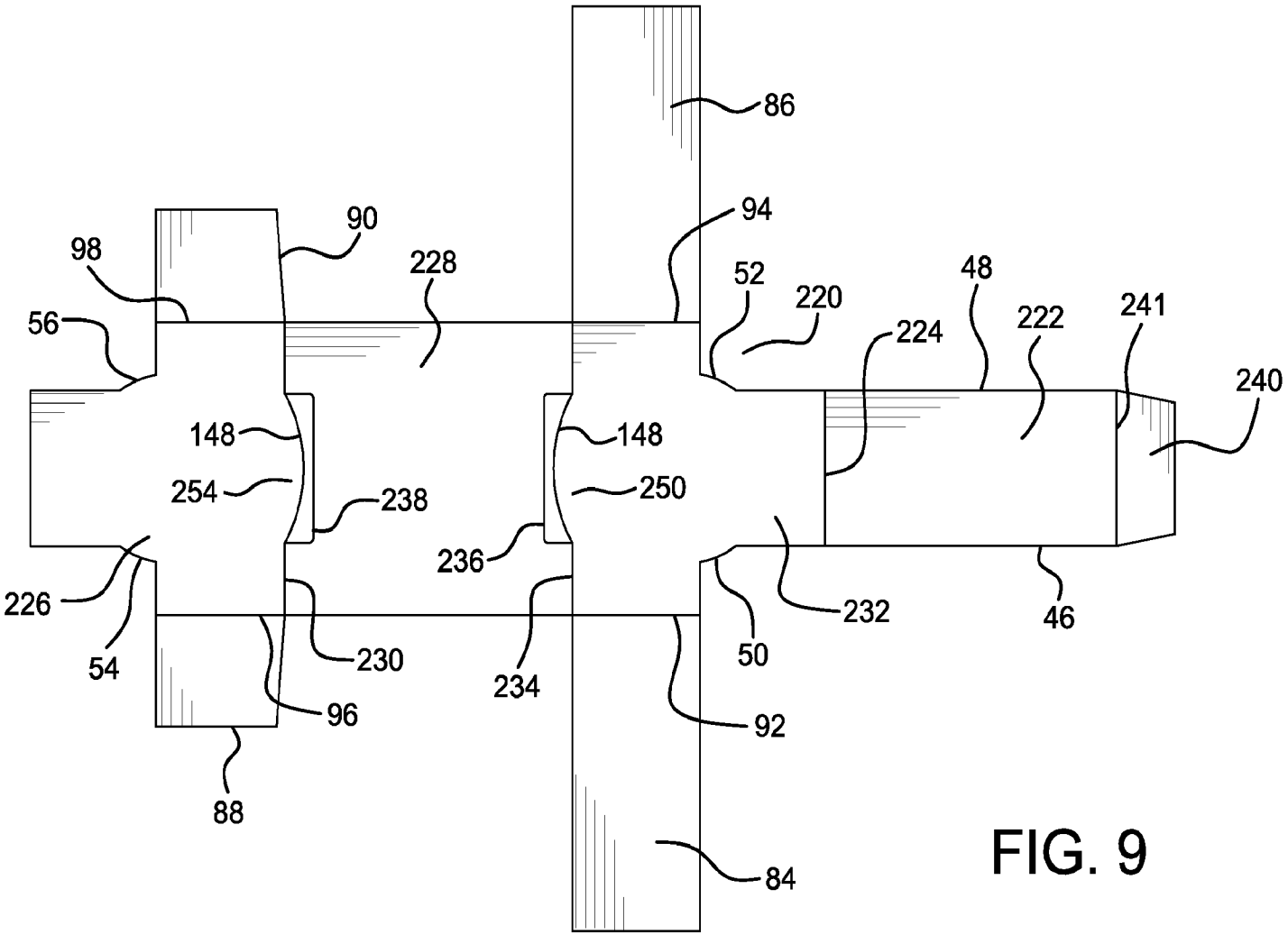
FIG. 9 shows a blank for a 2-cup package enclosure with 3 glue joints.
Figure 10G:
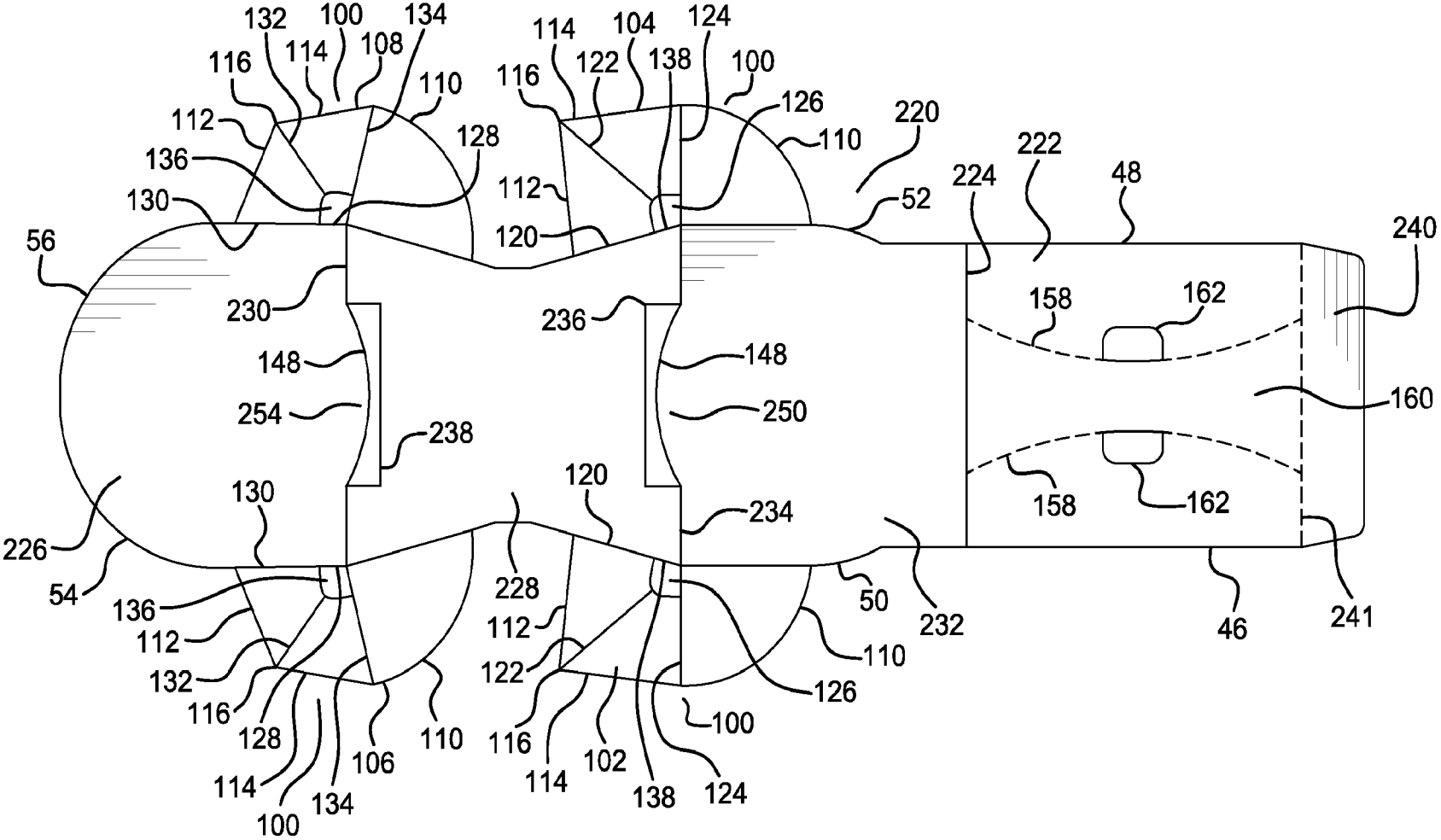
FIG. 10G shows a blank for the 2-cup package enclosure with 1-glue joint shown in FIG. 10A.
Figure 11F:
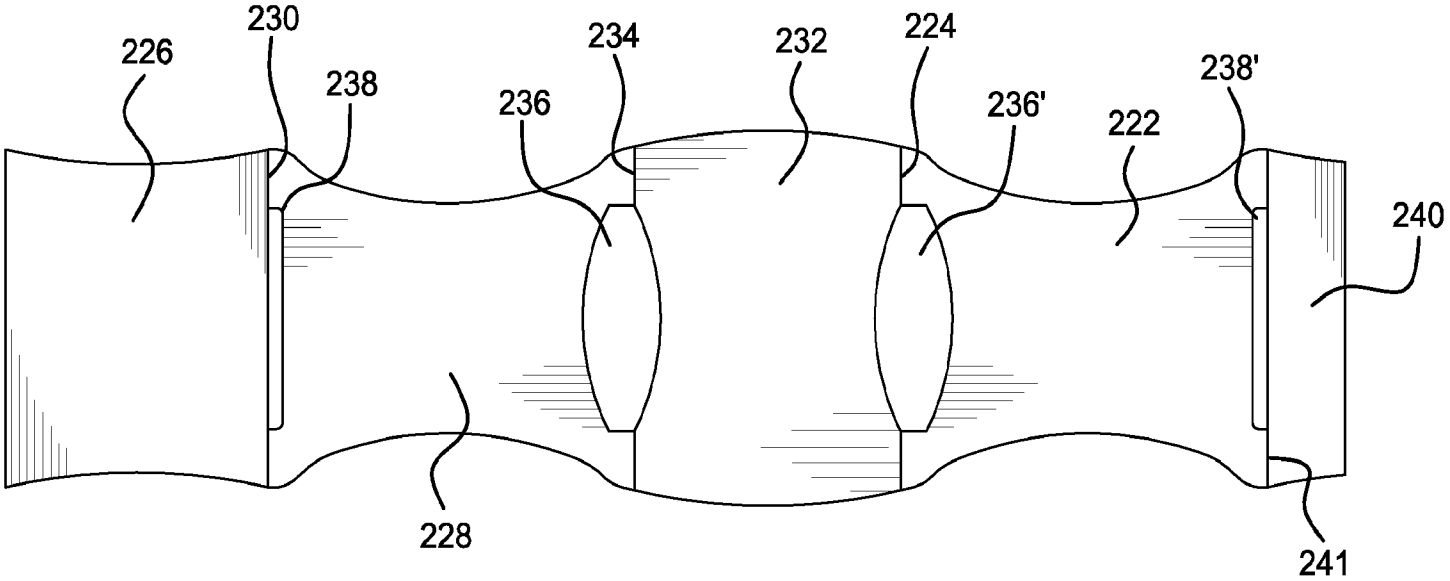
FIG. 11F shows a blank for the 2-cup package enclosure with 1-glue joint shown in FIG. 11A.

Another feature of the invention is the unitary blank used to assemble each embodiment of the enclosures 20 and 220. As described in relation to the side closure embodiments, unitary blanks may be assembled into enclosures as 5-glue joint, 3-glue joint (two-cup), 1-glue joint, and no glue joint configurations. For example, embodiments of blanks for four cup enclosures 20 are disclosed. Enclosure 20 shown in FIG. 4A may be assembled from the blank shown in FIG. 4G. Enclosure 20 shown in FIG. 5A may be assembled from the blank shown in FIG. 5G. Enclosure 20 shown in FIG. 6A may be assembled from the blank shown in FIG. 6G. Further embodiments of blanks for two cup enclosures 220 are also disclosed. Enclosure shown in FIG. 8A may be assembled from the blank shown in FIG. 8G. Additional embodiments of blanks for a two cup enclosures are shown in FIGS. 9, 10G, and 11F and can be assembled according to the disclosure of the invention.

As previously discussed in relation to embodiments of the assembled four cup and two cup enclosures, the blanks generally comprise front panel 22 or 222 with tab 36 or 240, bottom panel 26 or 226 with or without curvilinear edges, rear panel 28 or 228 with or without elliptically shaped projections, top panel 32 or 232 with or without curvilinear edges, and side closures (as described in its various embodiments) except for the embodiment shown in FIGS. 11A-11F. Scored fold lines—some perforated as described with certain embodiments (FIG. 4G for example)—are provided to delineate the features of the blank for ease in automated assembly and, ultimately, as structural characteristics of fully assembled enclosures of the invention.

Figure 7:
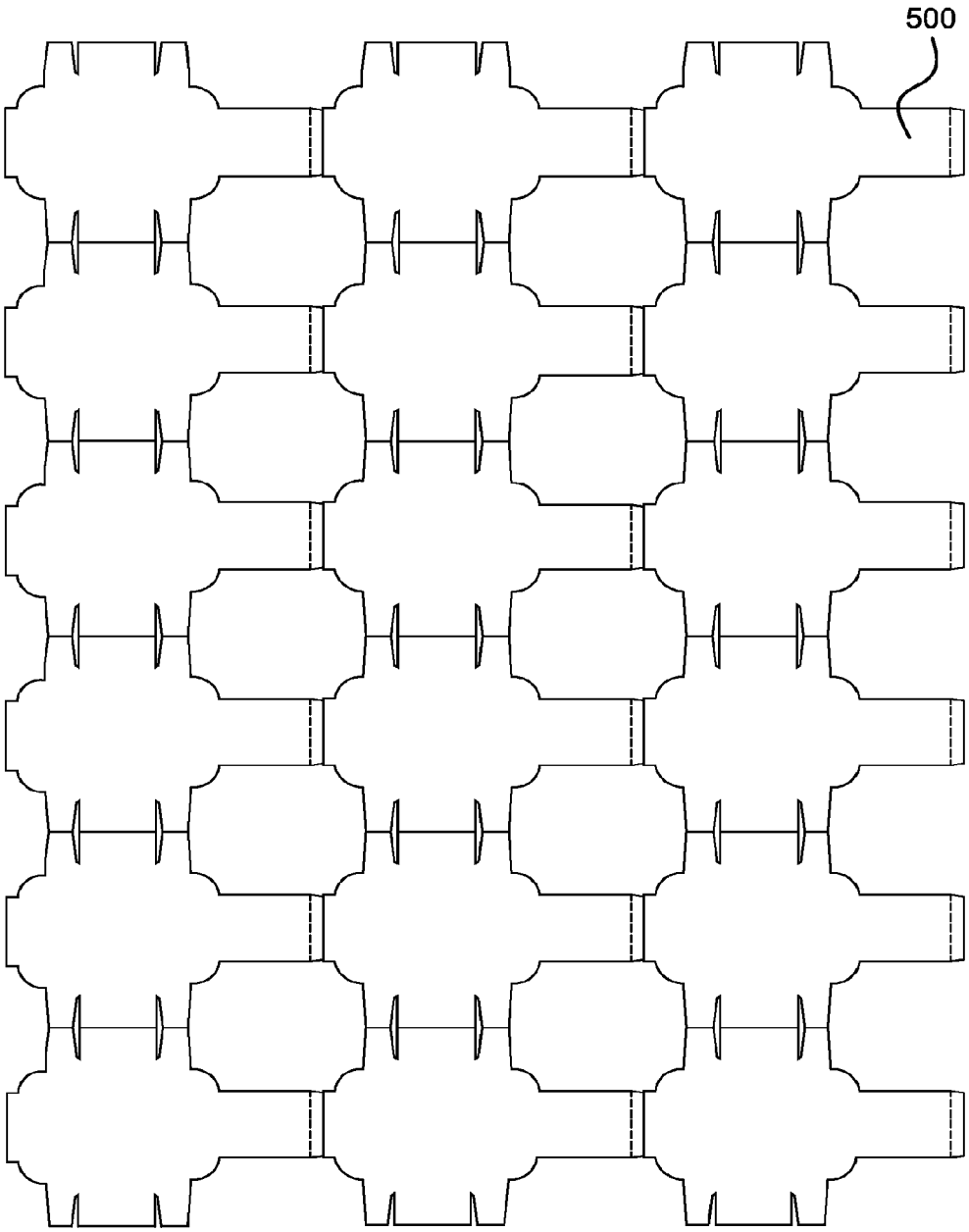
FIG. 7 shows unitary paperboard pre-cut with blanks for a 4-cup package enclosure.

As shown generally in FIG. 7, multiple blanks may be cut from material stock 500, such as, for example, paperboard, into desired blank dimensions. This allows for maximization of paperboard with less waste. Preparation of the blanks may occur either manually or by using any commercial fabrication technology, such as, for example, die cutting.

While a general overview of embodiments of the assembled enclosures are shown in FIGS. 4A-F, 5A-F, 6A-F, 8A-F, 10A-F, and 11A-E, further aspects of the invention include the methods of assembling the unitary blanks (FIGS. 4G, 5G, 6G, 8G, 9, 10G, and 11F) into finished enclosures for cups 200. FIGS. 4G, 4H, and 4I illustrate an exemplary process for assembling 5-glue joint enclosure 20 into a fully assembled enclosure 20 exemplified generally in FIGS. 4A-4F. This is described in further detail as follows. The assembly process may be adapted for the various embodiments of the enclosure. Assembly may be performed by automation with industrial machinery or other means.

As a first step, the process includes preparing a blank for the desired embodiment of enclosure 20 shown generally in FIG. 4G. While the blank of FIG. 4G reflects similar curvilinear edges 50, 52 along the front of top panel 32 and curvilinear edges 54, 56 along the front edge of bottom panel 26, FIGS. 4H and 4I show alternative offset curvilinear edges. This difference does not alter the assembly steps. The material stock may be prepared manually or by automation by cutting it into any of the dimensions of the disclosed blanks.

With the blank prepared for the desired enclosure embodiment, it is folded along the various scored fold lines into the hollow enclosure shape shown in FIG. 4H. While the method is described for a 5-glue joint enclosure for four cups, the preparation steps for 1-glue and no-glue joint enclosures for four cups and 5-glue, 3-glue, 1-glue, and no-glue joint enclosures for two cups is generally similar, but may require adaptation of assembly because of differences between embodiments of enclosures 20 and 220. Preparation of embodiments of four cup enclosure 20, tab 36 of front panel 22 (contiguous with top panel 32) is affixed with glue to the top surface of bottom panel 26 such that front panel 22 is configured substantially at 90 degrees with top panel 32 and bottom panel 26. In alternative embodiments (previously disclosed), a tab may be affixed to the bottom surface of bottom panel 26. In a further embodiment, a tab of the front panel (contiguous with the bottom panel) may be affixed to the top surface or bottom surface of top panel. The hollow carton-like shape of the enclosure is now generally formed as shown in FIG. 4H. This step can be executed manually or by automation with commercial technology.

With the hollow carton-like shape of enclosure 20 formed, cups 200 are stacked bottom to bottom and placed within enclosure 20 shown in FIG. 4I. In all embodiments of enclosures 20, 220—whether two cup or four cup—portions of cup edges 202 of cups 200 are engaged within and partially extend into the slots provided in the rear panel (shown, for example, in FIG. 4C or 5C) and cups 200 are substantially—if not wholly—positioned within the hollow confines of enclosure 20 or 220. Cups 200 may be stacked manually or by automation in any commercial continuous stacking or packaging process.

Once cups 200 are placed within enclosure 20, side closures are assembled. This side closure assembly step differs between its various embodiments. Assembling side closures for 2-cup and 4-cup enclosures may be completed during the same step.

In an illustrative embodiment of side closures for 5-glue joint enclosure 20 shown in FIGS. 4A-4I, side closures 40 are folded along scored fold lines 58 with rear panel 28. Upper foldable tabs 60, 62 provided along the top of side closures 40 are folded inward and affixed with glue to either the top surface or bottom surface of top panel 32. Lower foldable tabs 64, 66 provided along the bottom of side closures 40 are also folded inward along scored fold line 58 and affixed with glue to either the top surface or bottom surface of bottom panel 26. Side closures secure cups 200 within enclosure 20. Of course, this same assembly process may take place with the two-cup enclosure 220 shown in FIGS. 8A-8F.

In an embodiment of a 3-glue joint enclosure 20 as previously described for two-cup enclosure 220, single panels are folded along scored fold lines with top panel 232. Tabs at the end of the single panels are also folded inward so that the tabs may be affixed with glue to the interior or exterior surface of bottom panel 226. In an alternative configuration, the single panels are folded along their edges with the top panel and the tabs are also folded inward so that the tabs may be affixed with glue or other adhesive agent to the top or bottom surface of the bottom panel. The side closures secure cups 200 within enclosure 220.

In another embodiment of a 3-glue joint enclosure 20 blank shown in FIG. 9, upper tabs 84, 86 are folded along scored fold lines 92, 94 with top panel 32. Lower tabs 88, 90 are folded along scored fold line 96, 98 with bottom panel 26 so that corresponding upper tabs 84, 86 and lower tabs 88, 90 overlap on each end of enclosure 20. At the point of overlap, corresponding upper tabs 84, 86 and lower tabs 88, 90 are affixed with glue or other adhesive agent. Side closures 82 secure cups 200 within enclosure 220.

As an example of a 1-glue joint enclosure 20 shown in FIGS. 5A and 6A, point 116 each for upper closures 102, 104 are folded inward into enclosure 20 between cups 200 and rear panel 28 such that each is placed sufficiently adjacent to rear panel 28. Likewise, point 116 each for lower closures 106, 108 are folded inward into enclosure 20 between cups 200 and bottom panel 28 such that each is placed sufficiently adjacent to bottom panel 26. In assembled enclosure 20, curvilinear edges 110 of upper side closures 102, 104 run from top panel 32 to adjacent—if not in direct contact with—rear panel 28, and curvilinear edges 110 of lower side closures 106, 108 run from bottom panel 26 to adjacent—if not in direct contact with—rear panel 28. Side closures 100 secure cups 200 within enclosure 20. Of course, this same assembly process may take place with the two-cup enclosure 220 shown in FIGS. 10A-10G.

In other embodiments, locks such as, for example, lock tab 600 and slit 602, may be used to connect a front panel to bottom panel or top panel of enclosures 20 or 220. Lock tab 600 and slit 602 may also be used as an alternative to attach side closures to themselves or the top panel or bottom panel of enclosures 20 or 220.

Fully assembled enclosures 20 and 220 enclosing cups 200 may then be stacked and placed into larger boxes for storage, transport, and shelf display.

While the invention has been described above in conjunction with specific embodiments, it is evident that many alternatives, modifications, permutations, and variations will become apparent to those skilled in the art in light of the foregoing description. Accordingly, it is intended that the present invention embraces all such alternatives, modifications, and variations as falling within the scope of the claims below.

What is claimed is:

1. A package comprising:

an enclosure in a shape of a hollow and substantially rectangular polyhedron configured to hold at least two food cups that are stacked bottom to bottom;

two curved planar openings aligned adjacent to opposing sides of a front panel of the enclosure, wherein each of the two curved planar openings is defined by curvilinear edges of a top panel and of a bottom panel and an edge of the front panel, wherein each of the curvilinear edges comprises an arc less than 90 degrees, and wherein each of the two curved planar openings is configured to provide a view into the outer package;

two side closures configured to secure the foods cups in the enclosure;

at least two slots in a rear panel, wherein each slot is configured to receive part of a top circumferential edge of one of the food cups;

two upper corners formed by the rear panel, the top panel, and the two side closures; and two lower corners formed by the rear panel, the bottom panel, and the two side closures.

2. The package of claim 1 wherein the front panel is joined along a contiguous edge with the bottom panel and is affixed to the top panel with a tab having a folded edge.

3. The package of claim 2 wherein the contiguous edge and the folded edge comprise perforations to facilitate removal of the front panel from the package and access to the food cups.

4. The package of claim 1 wherein the front panel is joined along a contiguous edge with the top panel and is affixed to the bottom panel.

5. The package of claim 1 wherein each side closures is contiguous with opposite sides of the rear panel and is affixed by tabs to the top panel and the bottom panel.

6. The package of claim 1 wherein the enclosure comprises two side closures, wherein each of the side closures has a first tab overlapping with and affixed to a second tab, wherein the first tab is contiguous with the top panel, and wherein the second tab is contiguous with the bottom panel.

7. The package of claim 1 wherein the enclosure comprises a lock contiguous with the front panel and a receiving slit for the lock in the bottom panel.

8. The package of claim 1 wherein a first set of side closures fold along a first axis at an angle that is acute to the rear panel and a second set of side closures fold along a second axis at an angle that is also acute to the rear panel.

9. The package of claim 8 wherein the first set of side closures and the second set of side closures comprise apertures.

10. The package of claim 1 wherein the top panel is contiguous along a first edge with the rear panel and wherein the rear panel is contiguous along a second edge with the bottom panel.

11. The package of claim 1 wherein the at least two slots are aligned with each other in the rear panel of the enclosure.

12. The package of claim 11 wherein the enclosure is configured to hold one set of food cups that are stacked bottom to bottom.

13. The package of claim 11 wherein a curvilinear projection extends perpendicular to each slot.

14. The package of claim 11 wherein two sets of slots are aligned relative to one another in the rear panel of the enclosure.

15. The package of claim 14 wherein the enclosure is configured to hold two sets of food cups that are stacked bottom to bottom.

16. The package of claim 14 wherein a curvilinear projection is adjacent to and extends perpendicular to each slot.

17. A unitary blank for forming a hollow and substantially rectangular outer package for food cups comprising:

a front panel contiguous with a tab along a first scored fold line;

a bottom panel contiguous with the front panel along a second scored fold line, the bottom panel comprising at least two curvilinear edges adjacent to the front panel wherein each of the at least two curvilinear edges comprises an arc less than 90 degrees;

a top panel comprising at least two curvilinear edges adjacent to the front panel wherein each of the at least two curvilinear edges comprises an arc less than 90 degrees;

a rear panel contiguous with the bottom panel along a third scored fold line and contiguous with the top panel along a fourth scored fold line;

a first set of slots in the rear panel along the fourth scored fold line, wherein each of the first set of slots comprises an elliptical edge;

a second set of slots in the rear panel along the third scored fold line, wherein each of the second set of slots comprises an elliptical edge;

side closures contiguous with the rear panel;

wherein the rear panel, the top panel, and the side closures are configured to form two upper corners; and wherein the rear panel, the bottom panel, and the side closures are configured to form two lower corners.

18. The unitary blank of claim 17 wherein the first scored fold line is perforated.

19. The unitary blank of claim 17 wherein the second scored fold line is perforated.

20. The unitary blank of claim 17 wherein the bottom panel comprises three curvilinear edges.

21. The unitary blank of claim 17 wherein the bottom panel comprises four curvilinear edges.

22. The unitary blank of claim 17 wherein each of the side closures comprises a panel contiguous with and at opposite ends of the rear panel along scored fold lines.

23. The unitary blank of claim 22 wherein the panel comprises foldable tabs.

24. The unitary blank of claim 17 wherein each of the side closures comprises a first pair of foldable tabs and a second pair of foldable tabs.

25. The unitary blank of claim 24 wherein the first pair of foldable tabs are contiguous with opposite ends of the top panel along a fifth set of scored fold lines and with opposite ends of the rear panel along a sixth set of scored fold lines.

26. The unitary blank of claim 25 wherein each foldable tab comprises an aperture.

27. The unitary blank of claim 26 wherein each foldable tab of the first pair of foldable tabs comprises a seventh scored fold line at an angle that is acute to the fifth set of scored fold lines adjacent the top panel and to the sixth set of scored fold lines adjacent the rear panel.

28. The unitary blank of claim 27 wherein the scored fold lines are perforated.

29. The unitary blank of claim 25 wherein the second pair of foldable tabs are contiguous with opposite ends of the rear panel along a seventh set of scored fold lines and with opposite ends of the bottom panel along an eighth set of scored fold lines.

30. The unitary blank of claim 29 wherein each of the second pair of foldable tabs comprise a ninth scored fold line at an angle that is acute to the fourth set of scored fold lines adjacent the rear panel and a tenth set of scored fold lines adjacent to the bottom panel.

31. The unitary blank of claim 29 wherein the seventh set of scored fold lines and the eighth set of scored fold lines are perforated.

32. The unitary blank of claim 17 wherein the rear panel comprises at least one pair of aligned slots.

33. The unitary blank of claim 32 wherein the rear panel comprises two pairs of aligned slots.

34. The unitary blank of claim 32 wherein each slot is substantially rectangular and has a curvilinear edge.

35. A package for two cups comprising:

an enclosure comprising a top panel, a bottom panel, a front panel, and a rear panel that form a hollow and substantially rectangular polyhedron configured to hold a first cup and a second cup stacked bottom to bottom;

two curved planar openings at opposite sides of the front panel of the enclosure, wherein the two curved planar openings are each defined by corresponding curvilinear edges of the top panel and of the bottom panel and a side edge of the front panel, and wherein each of the curvilinear edges comprises an arc less than 90 degrees and wherein the two curved planar openings are configured to provide a view into the package;

two side closures, each of which is contiguous with opposite sides of the rear panel, wherein the two side closures are configured to secure the first cup and the second cup in the enclosure;

a first slot aligned in the rear panel along a contiguous edge between the bottom panel and the rear panel and a second slot aligned in the rear panel along a contiguous edge between the top panel and the rear panel, wherein the first slot is configured to receive part of a top circumferential edge of the first cup and the second slot is configured to receive part of a top circumferential edge of the second cup, whereby the first slot and the second slot are also configured to securely fit the first cup and the second cup in the enclosure;

two upper corners formed by the rear panel, the top panel, and the two side closures; and two lower corners formed by the rear panel, the bottom panel, and the two side closures.

36. The package of claim 35 wherein the top circumferential edges of each of the first cup and the second cup substantially align with the curvilinear edges of the top panel and the bottom panel.

37. The package of claim 35 wherein the front panel comprises two substantially linear perforations that facilitate removal of the front panel from the package.

38. The package of claim 35 wherein each of the two side closures is affixed by tabs to the top panel and to the bottom panel.

39. The package of claim 35 wherein the enclosure comprises a lock contiguous with the front panel and a receiving slot for the lock in the bottom panel.

40. The package of claim 35 wherein the enclosure comprises a first set of side closures contiguous with the top panel and the rear panel and a second set of side closures contiguous with the rear panel and the bottom panel.

41. The package of claim 40 wherein each of the first set of side closures and each of the second set of side closures folds along axes at angles that are acute to the rear panel.

42. The package of claim 40 wherein the first set of side closures and the second set of side closures comprise apertures.

43. A package for four cups comprising:

an enclosure comprising a top panel, a bottom panel, a front panel, and a rear panel that define a hollow and substantially rectangular polyhedron configured to hold four cups stacked bottom to bottom in two sets;

two curved planar openings adjacent opposing ends of the front panel of the enclosure, wherein the two curved planar openings are each defined by corresponding curvilinear edges of the top panel and the bottom panel and an edge of the front panel, wherein each of the curvilinear edges comprises an arc that is less than 90 degrees, and wherein the two curved planar openings are configured to provide a view into the package;

two side closures, each of which is provided at and contiguous with opposite sides of the rear panel of the enclosure, wherein the two side closures are configured to secure four cups in the enclosure;

a first set of slots aligned along a contiguous edge between the bottom panel and the rear panel, wherein the first set of slots are configured to receive part of top circumferential edges of two of the four cups;

a second set of slots aligned along a contiguous edge between the top panel and the rear panel, wherein the second set of slots are configured to receive part of top circumferential edges of two of the four cups;

two upper corners formed by the rear panel, the top panel, and the two side closures; and two lower corners formed by the rear panel, the bottom panel, and the at least two side closures.

44. The package of claim 43 wherein the curvilinear edges of the top panel and the bottom panel are configured to substantially align with top circumferential edges of each of the four cups.

45. The package of claim 43 wherein the enclosure comprises two side closures wherein each side closure is affixed by tabs to the top panel and the bottom panel.

46. The package of claim 43 wherein the enclosure comprises a lock contiguous with the front panel and a receiving slot for the lock in the bottom panel.

47. The package of claim 43 wherein the enclosure comprises a first set of side closures contiguous with the top panel and the rear panel and a second set of side closures contiguous with the rear panel and the bottom panel.

48. The package of claim 47 wherein the first set of side closures and the second set of side closures fold along axes at acute angles to the rear panel.

* * * * *

UNITED STATES PATENT AND TRADEMARK OFFICE

CERTIFICATE OF CORRECTION

PATENT NO. : 9,290,301 B2
APPLICATION NO. : 13/292610
DATED : March 22, 2016
INVENTOR(S) : Daniel Dominski et al.

It is certified that error appears in the above-identified patent and that said Letters Patent is hereby corrected as shown below:

In the Claims:

Column 13, lines 9 through 29 should read:

Claim 1 A package comprising:

an enclosure in a shape of a hollow and substantially rectangular polyhedron configured to hold at least two food cups that are stacked bottom to bottom;

two curved planar openings aligned adjacent to opposing sides of a front panel of the enclosure, wherein each of the two curved planar openings is defined by curvilinear edges of a top panel and of a bottom panel and an edge of the front panel, wherein each of the curvilinear edges comprises an arc less than 90 degrees, and wherein each of the two curved planar openings is configured to provide a view into the outer package;

two side closures configured to secure the food cups in the enclosure;

at least two slots in a rear panel, wherein each slot is configured to receive part of a top circumferential edge of one of the food cups;

two upper corners formed by the rear panel, the top panel, and the two side closures; and two lower corners formed by the rear panel, the bottom panel, and the two side closures.

Column 13, lines 39 through 41 should read:

Claim 5 The package of claim 1 wherein each side closure is contiguous with opposite sides of the rear panel and is affixed by tabs to the top panel and the bottom panel.

Signed and Sealed this
Twenty-third Day of August, 2016

Michelle K. Lee

Michelle K. Lee
*Director of the United States Patent and Trademark Office*